US011680403B2

(12) United States Patent
Perez

(10) Patent No.: US 11,680,403 B2
(45) Date of Patent: Jun. 20, 2023

(54) MULTI-PURPOSE STRUCTURAL PANELS AND SYSTEMS FOR ASSEMBLING STRUCTURES

(71) Applicant: AMP IP LLC, Miami, FL (US)

(72) Inventor: Alain Perez, Miami, FL (US)

( * ) Notice: Subject to any disclaimer, the term of this patent is extended or adjusted under 35 U.S.C. 154(b) by 0 days.

(21) Appl. No.: 17/221,061

(22) Filed: Apr. 2, 2021

(65) Prior Publication Data

US 2022/0090379 A1 Mar. 24, 2022

Related U.S. Application Data

(60) Provisional application No. 63/161,678, filed on Mar. 16, 2021, provisional application No. 63/081,041, filed on Sep. 21, 2020.

(51) Int. Cl.

| | |
|---|---|
| ***E04C 2/52*** | (2006.01) |
| ***E04B 1/00*** | (2006.01) |
| ***E04B 2/02*** | (2006.01) |
| ***E04C 2/08*** | (2006.01) |
| ***E04B 1/08*** | (2006.01) |
| ***E04B 1/41*** | (2006.01) |
| ***E04C 2/36*** | (2006.01) |
| ***E04B 2/00*** | (2006.01) |
| ***E04B 5/02*** | (2006.01) |

(Continued)

(52) U.S. Cl.

CPC ..... *E04C 2/08* (2013.01); *E04B 1/08* (2013.01); *E04B 1/40* (2013.01); *E04C 2/36* (2013.01); *E04C 2/46* (2013.01); *E04C 2/50* (2013.01); *E04C 2/523* (2013.01); *E04B 2001/405* (2013.01); *E04B 2103/06* (2013.01); *E04C 2/292* (2013.01); *E04C 2002/004* (2013.01)

(58) Field of Classification Search

CPC ..... E04B 1/08; E04B 1/40; E04B 2001/405; E04B 2103/06; E04C 2/08; E04C 2/36; E04C 2/13; E04C 2/50; E04C 2/292; E04C 2/523; E04C 2002/004; F24F 7/00; F24F 7/06; F24F 7/10

USPC ..... 52/302.3, 302.1; 454/185, 186

See application file for complete search history.

(56) References Cited

U.S. PATENT DOCUMENTS 1,086,031 A * 2/1914 Davis ..... E06B 1/58 454/339
1,622,664 A * 3/1927 Murray ..... B21D 53/02 122/494

(Continued)

FOREIGN PATENT DOCUMENTS

| | | |
|---|---|---|
| CN | 103094790 | 5/2013 |
| CN | 204850694 | 8/2015 |

(Continued)

OTHER PUBLICATIONS

AGT Products, Dricore Smartwall 1,3, . . . https://dricore.com/products/smartwall/, Aug. 11, 2020.

*Primary Examiner* — Brian E Glessner
*Assistant Examiner* — James J Buckle, Jr.
(74) *Attorney, Agent, or Firm* — Malloy & Malloy PL

(57) ABSTRACT

The present invention is directed to a multi-purpose panel member which may be utilized as any surface or support beam in a structure. In a preferred embodiment, the panel may be extruded monolithically from aluminum. Also disclosed are systems for assembling structures from the panels utilizing a plurality of other components, which are also preferably extruded from aluminum.

17 Claims, 35 Drawing Sheets

(51) Int. Cl.

| | |
|---|---|
| *E04B 1/38* | (2006.01) |
| *E04C 2/292* | (2006.01) |
| *E04C 2/00* | (2006.01) |

(56) References Cited

U.S. PATENT DOCUMENTS

| | | | | |
|---|---|---|---|---|
| 1,972,570 | A * | 9/1934 | Moore | E04B 5/10 52/579 |
| 1,974,767 | A * | 9/1934 | Mills | F24D 5/10 165/56 |
| 2,039,601 | A * | 5/1936 | London | E04B 1/74 52/783.17 |
| 2,065,433 | A * | 12/1936 | Dercum | E04C 2/3405 52/783.17 |
| 2,143,288 | A | 1/1939 | Stolz | |
| 2,427,780 | A * | 9/1947 | Haines | F24F 7/04 454/339 |
| 2,762,472 | A * | 9/1956 | Jackson | E04C 2/08 52/579 |
| 4,454,694 | A | 6/1984 | Davanture | |
| 4,823,523 | A * | 4/1989 | Coupard | E04B 1/24 52/33 |
| 4,891,923 | A | 1/1990 | Ericsson et al. | |
| 5,010,777 | A | 4/1991 | Yehl et al. | |
| 5,483,778 | A | 1/1996 | Scrivener | |
| 6,260,323 | B1 * | 7/2001 | Hockey | E04B 2/74 52/238.1 |
| 6,282,858 | B1 | 9/2001 | Swick | |
| 6,412,243 | B1 * | 7/2002 | Sutelan | E04B 7/102 52/783.17 |
| 6,584,740 | B2 * | 7/2003 | Record | E04B 1/14 52/270 |
| 6,615,945 | B2 | 9/2003 | Minami et al. | |
| 7,127,865 | B2 * | 10/2006 | Douglas | E02D 27/02 52/745.13 |
| 8,065,846 | B2 * | 11/2011 | McDonald | E04B 5/10 52/281 |
| 8,490,355 | B2 | 7/2013 | Walker | |
| 8,534,018 | B2 | 9/2013 | Walker | |
| 8,539,732 | B2 | 9/2013 | Leahy | |
| 8,590,264 | B2 | 11/2013 | Leahy | |
| 8,677,698 | B2 | 3/2014 | Segall | |
| 8,677,713 | B1 | 3/2014 | Sheehy | |
| 8,869,492 | B2 | 10/2014 | Leahy | |
| 9,016,002 | B2 | 4/2015 | Segall | |
| 9,050,766 | B2 | 6/2015 | Walker | |
| 9,068,372 | B2 | 6/2015 | Quinn et al. | |
| 9,091,049 | B2 | 7/2015 | Walker | |
| 9,249,572 | B2 | 2/2016 | Neumayr | |
| 9,382,703 | B2 | 7/2016 | Quinn et al. | |
| 9,604,428 | B2 | 3/2017 | Walker | |
| 9,790,684 | B2 | 10/2017 | Neumayr | |
| 9,920,513 | B2 | 3/2018 | Segall | |
| 9,988,806 | B2 | 6/2018 | Segail | |
| 10,036,157 | B2 | 7/2018 | Segall | |
| 10,077,553 | B2 * | 9/2018 | Neumayr | E04B 2/44 |
| 10,787,803 | B2 | 9/2020 | Leahy | |
| 2004/0031230 | A1 | 2/2004 | Pabedinskas et al. | |
| 2007/0102960 | A1 | 5/2007 | Booher | |
| 2007/0189920 | A1 | 8/2007 | Gimzewski | |
| 2007/0266655 | A1 | 11/2007 | Howe et al. | |
| 2008/0010924 | A1 | 1/2008 | Pietruczynik et al. | |
| 2012/0317923 | A1 * | 12/2012 | Herdt | B29C 44/1214 52/783.11 |
| 2018/0038103 | A1 | 2/2018 | Neumayr | |
| 2018/0283664 | A1 | 10/2018 | Tuchler | |
| 2019/0210317 | A1 | 7/2019 | Walker | |
| 2019/0219307 | A1 | 7/2019 | Werner et al. | |

FOREIGN PATENT DOCUMENTS

| | | |
|---|---|---|
| CN | 105696706 | 7/2019 |
| DE | 2235322 | 1/1974 |
| EP | 0558767 | 9/1993 |
| EP | 1196668 | 7/2000 |
| EP | 2781866 | 8/2015 |
| EP | 3971355 | 3/2022 |
| ES | 2267389 | 6/2005 |
| ES | 2289881 | 2/2008 |
| JP | 2004324267 | 11/2004 |
| WO | WO9323629 | 11/1993 |
| WO | WO2018158986 | 9/2018 |
| WO | WO2019173279 | 9/2019 |
| WO | WO2019195874 | 10/2019 |

* cited by examiner

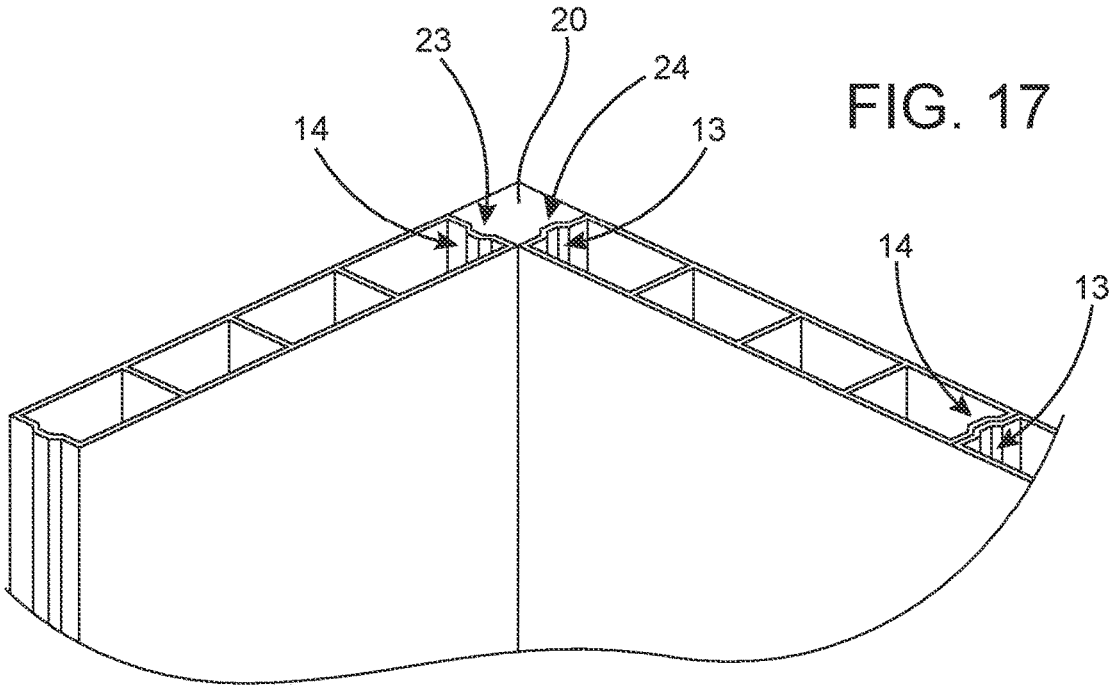
FIG. 17
FIG. 18
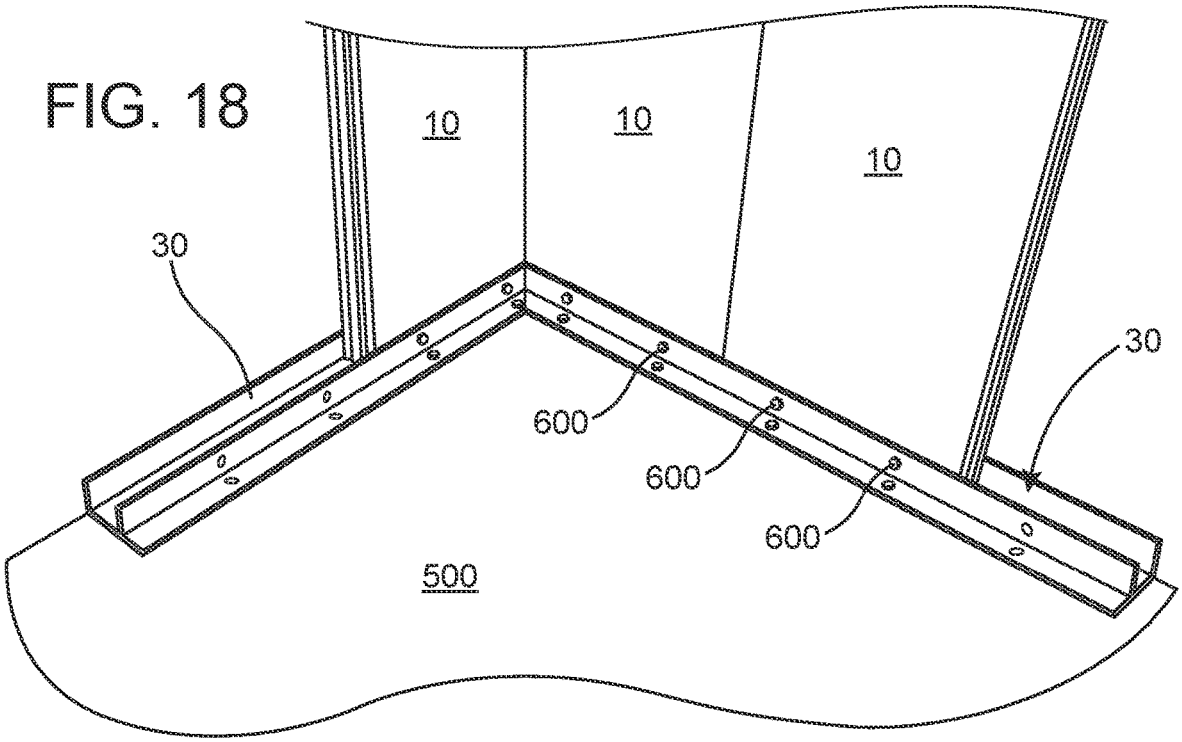

MULTI-PURPOSE STRUCTURAL PANELS AND SYSTEMS FOR ASSEMBLING STRUCTURES

PRIORITY CLAIM

The present invention claims the benefit, pursuant to 35 USC § 119(e), to U.S. Provisional Patent Application No. 63/081,041 filed on Sep. 21, 2020. The present invention also claims the benefit, pursuant to 35 USC § 119(e), to U.S. Provisional Patent Application No. 63/161,678, filed on Mar. 16, 2021.

BACKGROUND OF THE INVENTION

Field of the Invention

The present invention is directed to a multi-purpose structural panel which can be used for any surface or support member within a building or structure. The present invention also provides construction systems for assembling buildings and structures from the inventive panel member, the system including a variety of other components to facilitate assembly. The present invention is also directed to systems and methods for assembling buildings and structures from prefabricated, extruded alloy components.

Description of the Related Art

The "Structural Insulated Panel" (also referred to as "SIP") is a relatively new building material consisting of a foam core and two layers of sheathing, typically this is expanded polystyrene sandwiched between two thin metal veneers or oriented strand board. While they present some improvement over the typical lumber frame construction, there are several key issues. One major issue is durability and corrosion resistance. Because the panels are glued together, they tend to delaminate in poor conditions. SIPs also present difficulties when running mechanical, electrical, or plumbing lines through them as cuts through the SIP can reduce the strength of the panel. SIPs also have inadequate fire safety ratings and must be surrounded by a separate fire-rated product.

Intermodal shipping containers have also been utilized as an alloy-based construction system. However they tend to be difficult to work with and are only manufactured in a few standard sizes, leading to limited options for building configurations made from shipping containers. Therefore, the present invention presents substantial improvements in these and other areas.

SUMMARY OF THE INVENTION

The present invention is directed to improvements in construction technology by way of an inventive, multi-purpose structural panel member and systems and methods for its use. Primarily, the inventive panel member is an improved rectangular profile for aluminum extrusions that can be utilized as virtually any surface or support member within a building or structure. The panel is capable of withstanding load in any direction and includes interior channels for insulation and ventilation. As such, it may be employed as walls, ceilings, roofs, structural supports, girders, lintels, and the like.

In a preferred embodiment the panel is monolithically extruded from aluminum, such as 6082 T6 aluminum alloy. Other materials and construction methods may be employed however. By way of example, the particular alloy can be customized based on the location or use of the structure, such has high corrosion resistance for marine environments or low thermal coefficient for environments with extreme temperatures. Non-metal materials such as carbon fiber or basalt may be suitable as well. The panel may also be assembled from components, rather than monolithically formed.

The panel may be dimensioned to suit any desired construction element, however, the inventor has determined that an optimum dimension, suitable for a variety of construction techniques, is a rectangular profile approximately 4 inches in thickness by 24.5 inches in width. The length of the panel can also be as long as desired, particularly if the panel is extruded, but a maximum length of 60 feet allows the panel members to be transported on roadways. The panel can include a plurality of interior channels, approximately 4 inches by 6 inches, separated by webs spanning the two faces of the panel. The wall thickness of the panel member may be uniform in order to facilitate extrusion. The inventor has determined that an aluminum alloy of 6082 T6 need only $1/8^{th}$ inch uniform wall thickness in order to provide the strength and load resistance for hurricanes, high wind speeds, snow loading, and earthquakes.

Another aspect of the invention employs the inventive panel with a variety of other components to create a system in which buildings may be assembled, rather than constructed in the traditional sense. To elaborate, the panel members include male and female interlocking components, which are not critical, but facilitate alignment of the panel members. Tracks may be used to fasten the panel members to foundations and to one another in order to form ceiling, floor, and roof structures. Frame elements may be employed to cap off panel members in order to create flat surfaces on the edge of panel members, which facilitates openings for door jambs or windows.

In a preferred embodiment, the panels are substantially hollow or have channels within them and can accommodate a variety of purposes. By way of example, the channels can be utilized to run mechanical, electrical, or plumbing lines. Additionally, the channels may be utilized as ducting for air conditioning. Not only does this contribute to more efficient construction, but conditioning the air within the panel will more efficiently heat or cool the structure. This is due in part to the fact that conduction of heat from one side of the panel to the other (and therefore heat loss or heat gain from one side of the panel to the other) can be tempered by conditioning the air within the panel. Such a structure can virtually eliminate the need for drop ceiling construction because of the space saving design. It will be appreciated that the channels can also store and/or act as conduits for a variety of future home technologies.

In yet another embodiment, the channels can be configured to collect, transport, and/or store rainwater. Where the inventive panels are used as roof members, apertures can be selectively created to facilitate introduction of rainwater into the channels. The channels of roof members can also be disposed in communication with channels of other panel members, such as walls or ceilings, to facilitate transportation and/or storage of collected rain water.

Another feature of the present invention is the ability to create buildings which are electromagnetically insulated due to the use of aluminum panels for all surfaces of the building. This can provide benefits in certain scenarios, such as where it may be desirable to prevent radio frequency transmissions from entering or leaving a building. On the other hand, the present invention may also block radio transmissions between various rooms in the same building. In this scenario a wired mesh network or similar may be desired to promote coverage of WiFi, cellular, and other signals throughout the building.

Yet another feature of the invention is the ability to utilize certain panels in an electrically conductive fashion. While using the panels to conduct main electrical voltage (e.g., in the range of 100-240 V) should be done with extreme caution, low voltage electrical transmission can be accomplished relatively easily, and with less safety concern. Therefore, a variety of low voltage electronic equipment can be powered merely through contact with the surface of the panel. This can facilitate placement of such household items as air conditioning thermostats, smoke detectors, security alarm panels and sensors, cameras, and other items, including, but certainly not limited to, internet connected and/or "Internet of Things" devices. Additionally, the aluminum panels themselves can be utilized as transducers to more accurately and more efficiently determine temperatures within the building. As is known, the resistivity of aluminum changes with temperature fluctuations. Therefore, each aluminum panel can be utilized as a temperature sensor if the fluctuations in low voltage current applied across the panel are monitored. Therefore, the temperature of each room in a building can be monitored with far more granularity than is currently possible. "Smart" air conditioning systems can then direct cooled or heated air where necessary, such as by opening or closing diffuser grills in certain rooms. It will be appreciated that the use of the panels as sensors and/or transducers is not strictly limited to use as a temperature sensor.

The panel members of the present invention are not limited to use in buildings or enclosures, and instead may be utilized as virtually any structural member. As such, bridges and other spans may be rapidly assembled from the system of the present invention. The present invention may find particular suitability where a temporary and/or reusable structural member is desired, such as pedestrian bridges, staging for event venues, or possibly even as a structural pool cover providing additional floor space to hotels.

Yet another advantage of the present invention is that building components may be sold by weight, instead of per piece. Given that all of the components of the system may be made from extruded aluminum, a total mass of aluminum required to assemble any structure can be calculated from the known quantities of components required for the structure. Therefore, the material cost to construct a particular structure can be estimated with ease.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 17 is a detail partial cutaway perspective view showing various components assembled according to a system of the present invention.

FIG. 18 is a detail cutaway perspective view showing various components assembled according to a system of the present invention.

Like reference numerals refer to like parts throughout the several views of the drawings.

DETAILED DESCRIPTION OF THE PREFERRED EMBODIMENT

Figure 1:
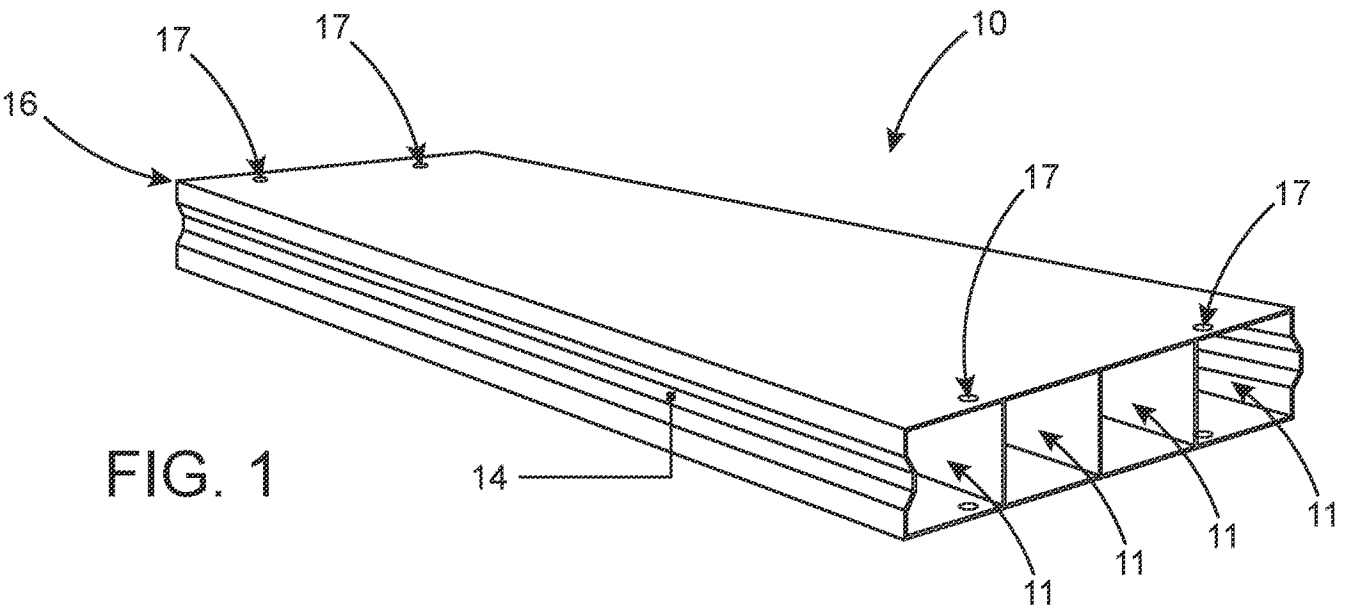
FIG. 1 is a perspective view of a panel member in accordance with one embodiment of the present invention.
Figure 2:
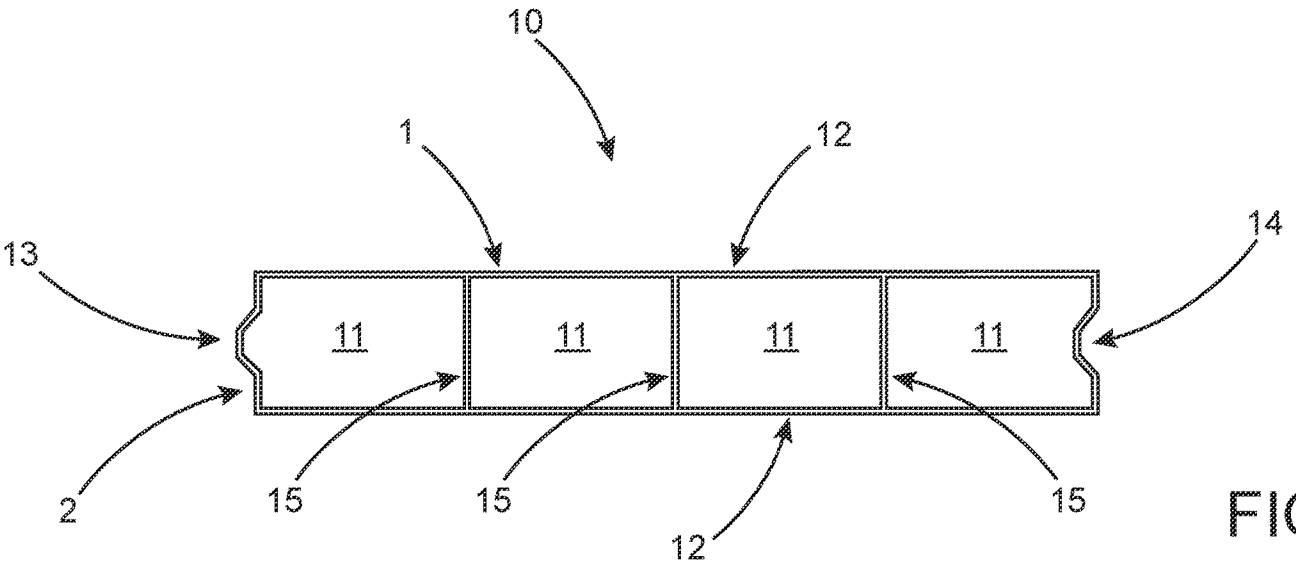
FIG. 2 is a front isometric view of the panel member depicted in FIG. 1.

While the overall construction system of the present invention will be disclosed in detail, it is worthwhile to first discuss the various individual components of the system. With reference to FIGS. 1 and 2, a preferred embodiment of a panel member or panel 10 is depicted. The panel 10 is preferably formed monolithically, such as by extrusion, but assembly of a panel 10 from a plurality of components may be possible. The panel 10 includes two oppositely disposed faces 12 supported by a plurality of webs 15. The faces 12 also define a long edge 1 of the profile of the panel 10. The panel 10 also includes a ridge member 13 and a valley member 14 defining a short edge 2 of the profile of the panel 10. The ridge member 13 and valley member 14 also serve to facilitate a mating relationship between consecutive, adjoining panel members 10 when utilized for construction of a wall, floor, or ceiling, for example. It will be understood that the precise shape of the ridge member 13 and valley member 14 are not critical, so long as they can facilitate a mating relationship. In the Figures, they are represented as simple shapes. The webs 15 at least partially define a plurality of channels 11 that run lengthwise along the panel 10 and terminate in open ends 16 at each end of the panel 10. The panels 10 may also include a plurality of mounting apertures 17 located where desired, and as discussed further below, may be placed to coordinate with other mounting apertures on the various components of the system of the present invention.

Figure 5:
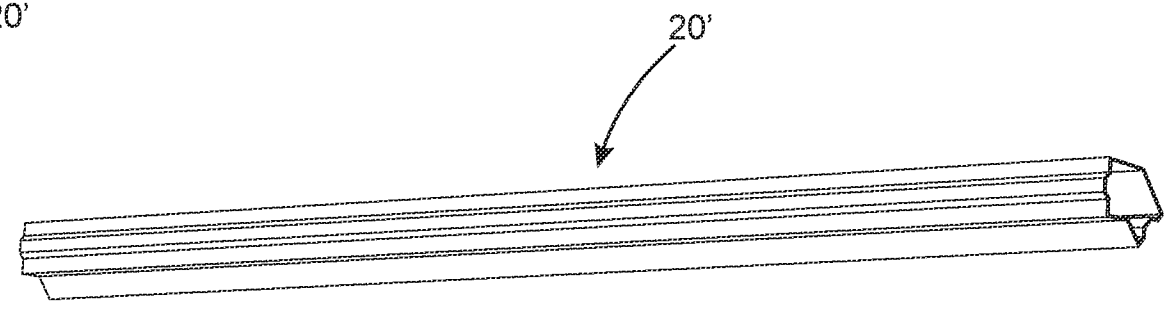
FIG. 5 is a perspective view of a corner bracket according to another embodiment of the present invention.
Figure 6:
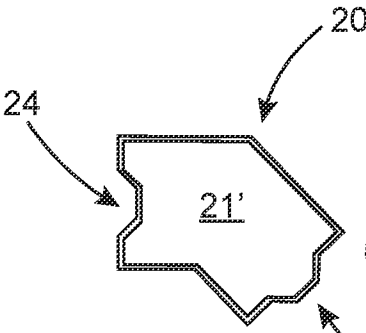
FIG. 6 is a front isometric view of the corner bracket depicted in FIG. 6.
Figure 3:
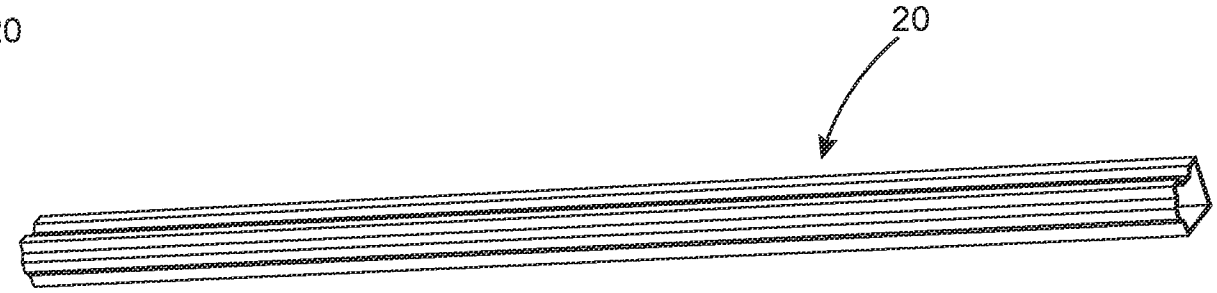
FIG. 3 is a perspective view of a corner bracket according to one embodiment of the present invention.
Figure 4:
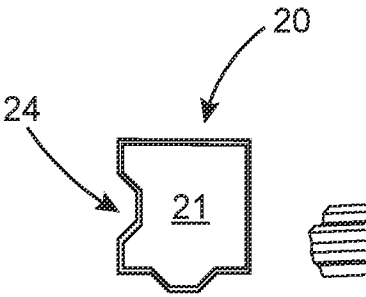
FIG. 4 is a front isometric view of the corner bracket depicted in FIG. 3.

Turning to FIGS. 3 through 6, two corner brackets 20, 20' are presented which may be employed with one embodiment of the present invention, though they are not required or necessary. As can be seen the corner bracket 20, 20' is essentially an enclosed channel 21, 21' with a ridge member 23, 23' and valley member 24, 24' disposed on faces to facilitate the adjoining of panels 10 at angles other than zero (i.e., not in a straight line). A relatively standard corner angle in building construction is ninety degrees, which is represented in FIGS. 3 and 4. As can be seen, the ridge member 23 and valley member 24 are orthogonal to each other, which facilitates the adjoining of consecutive panel member 10 at ninety degree angles. However, virtually an adjoinment angle may be accommodated as represented by FIGS. 5 and 6.

Figure 7:
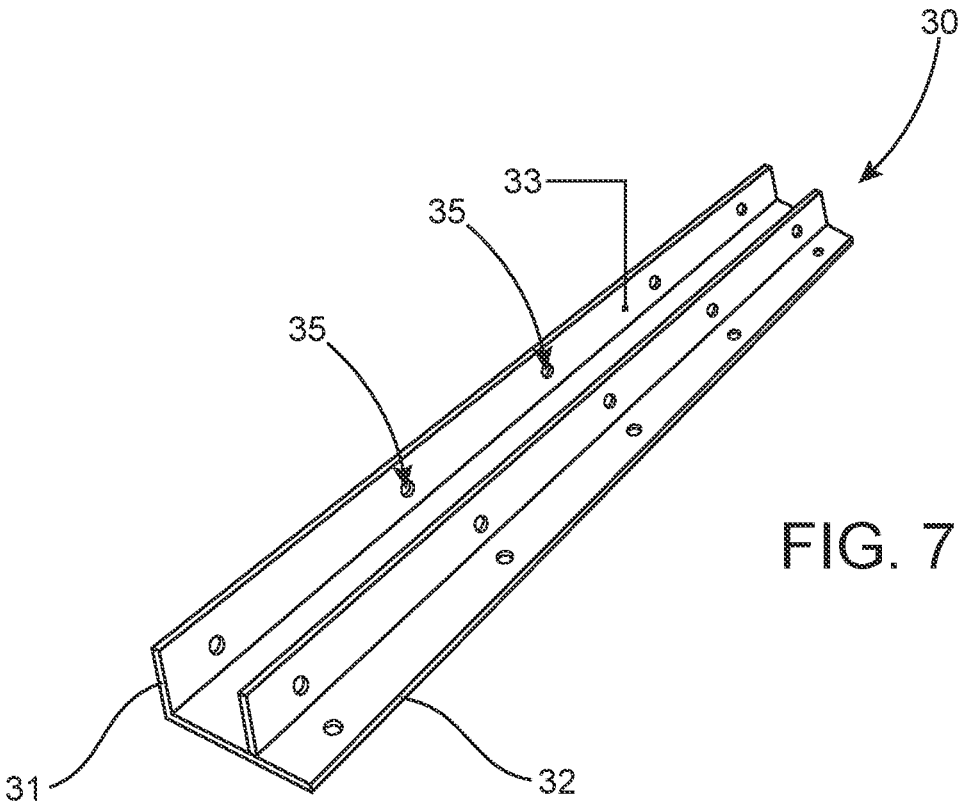
FIG. 7 is a perspective view of a track according to one embodiment of the present invention.

FIG. 7 represents a track 30 according to a preferred embodiment of the present invention. The track includes a channel 33 at least partially defined by two webs 31, as well as an external flange 32. Panel members 10 may be inserted into the channel 33 to facilitate alignment and fastening when construction walls, floors, or ceilings. In that regard, the mounting apertures 35 may be aligned with the mounting apertures 17 of the panel members (as depicted in FIG. 1) in order to facilitate fastening of a panel 10 to the track 30.

Figure 8:
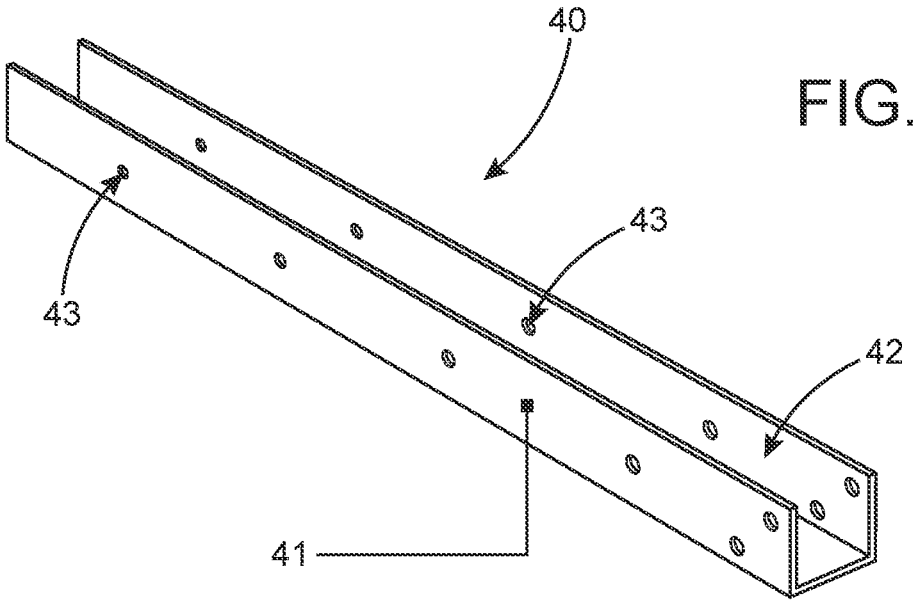
FIG. 8 is a perspective view of a frame according to one embodiment of the present invention.

Turning now to FIG. 8, a frame 40 in accordance with a preferred embodiment of the present invention is depicted. The frame 40 may serve as an end cap when required, such as when framing window openings with panels 10. As such it includes a channel 42 at least partially defined by webs 41, and is distinguished from the track by the lack of an external flange. The frame 40 may also include a plurality of mounting apertures 43 in order to facilitate fastening to a panel 10.

Figure 9:
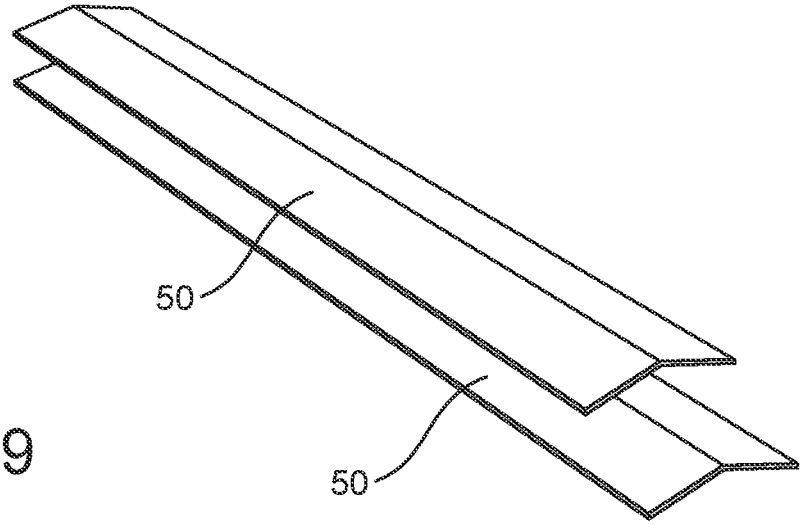
FIG. 9 is a perspective view of a pair of ridge plates in accordance with one embodiment of the present invention.
Figure 10:
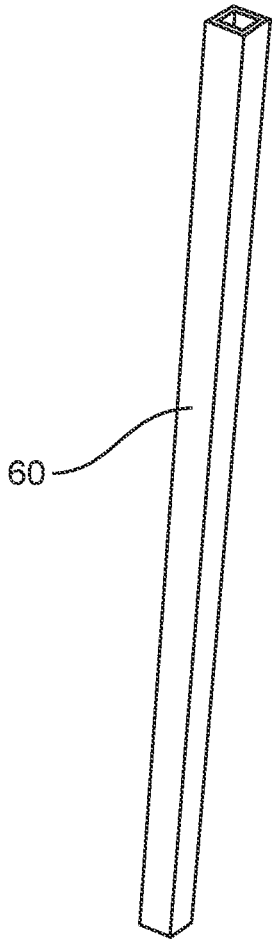
FIG. 10 is a perspective view of a reinforcement insert according to one embodiment of the present invention.

FIG. 9 depicts a ridge plate 50 to facilitate adjoinment of panel members along the ridge of a gabled roof. FIG. 10 depicts an insert 60, essentially an enclosed channel or box beam, which may be inserted into a channel 11 of a panel 10 in order to provide structural reinforcement for the panel 10, e.g., when used as a support beam or girder. The insert 60 may also be used to increase the safety margin for a free-standing span or cantilevered configuration of panels 10.

Now that several of the individual components have been described, the interconnectivity of the components can be discussed. With reference to FIGS. 11 through 16, several partial, detail views of assemblies created with the foregoing components can be seen. In each of the views, a plurality of panels 10, tracks 30, and frames 40 are disposed in various configurations on top of a foundation 500 for a structure such as a home or building. As can be seen, the panels are used to form the various external and internal walls, ceilings, upper story floors, and the roof of the building. The tracks 30 are utilized to secure the panels 10 to the foundation 500 and to each other when two panels are joined to form a ceiling/floor or roof connection with a wall. The frames 40 serve as an "end cap" when framing a window, otherwise the interior opening of the window would not be a uniform, flat surface given the existence of the valleys 14 and ridges 13 on the panels 10.

Figure 11:
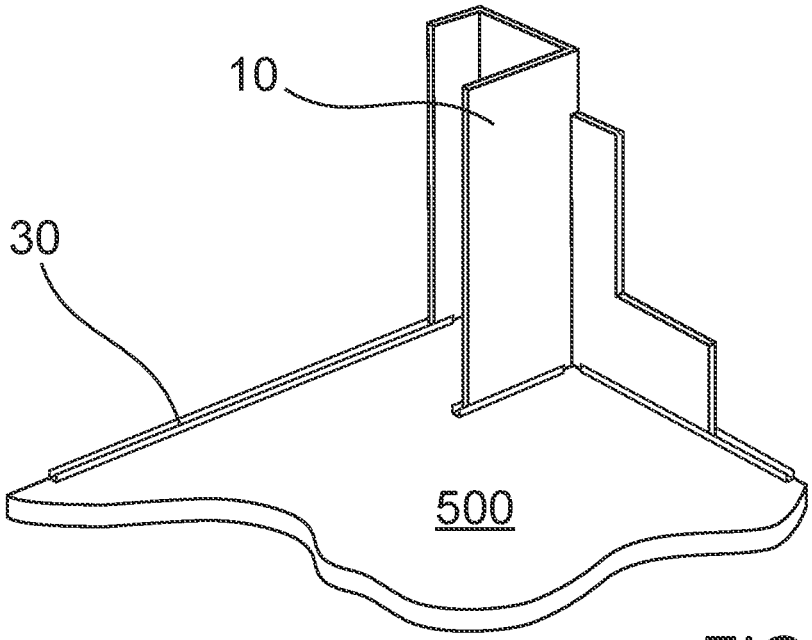
FIG. 11 is a partial cutaway perspective view showing various components assembled according to a system of the present invention.
Figure 12:
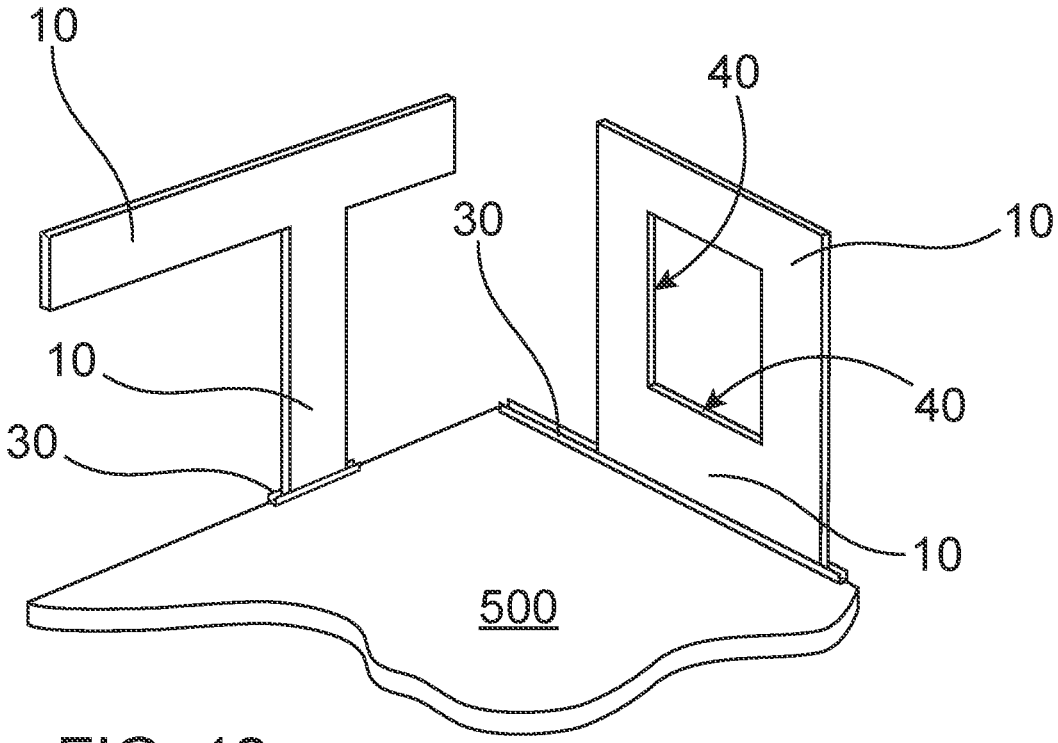
FIG. 12 is a partial cutaway perspective view showing various components assembled according to a system of the present invention.

In FIG. 11, a plurality of tracks 30 are fastened to a foundation 500 and are being utilized to support a plurality of panel members 10 in a vertical orientation to be utilized as wall members. In FIG. 12, two panel members can be seen in a "T" configuration to show that the panel members may also be used as columns and support beams. Also, in FIG. 12, the panels 10 have been arranged to form a window by suspending a panel 10 as a lintel across two other panels 10 acting as columns. It may also be seen that frames 40 are fastened to the interior of the window in order to prepare a flat surface for installation of the window and/or window jamb.

Figure 13:
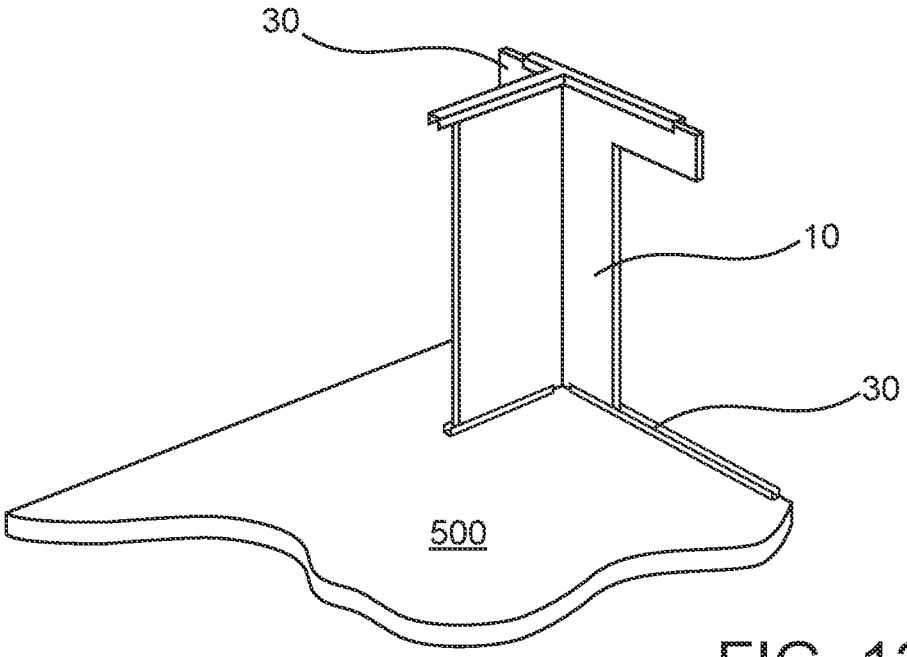
FIG. 13 is a partial cutaway perspective view showing various components assembled according to a system of the present invention.
Figure 14:
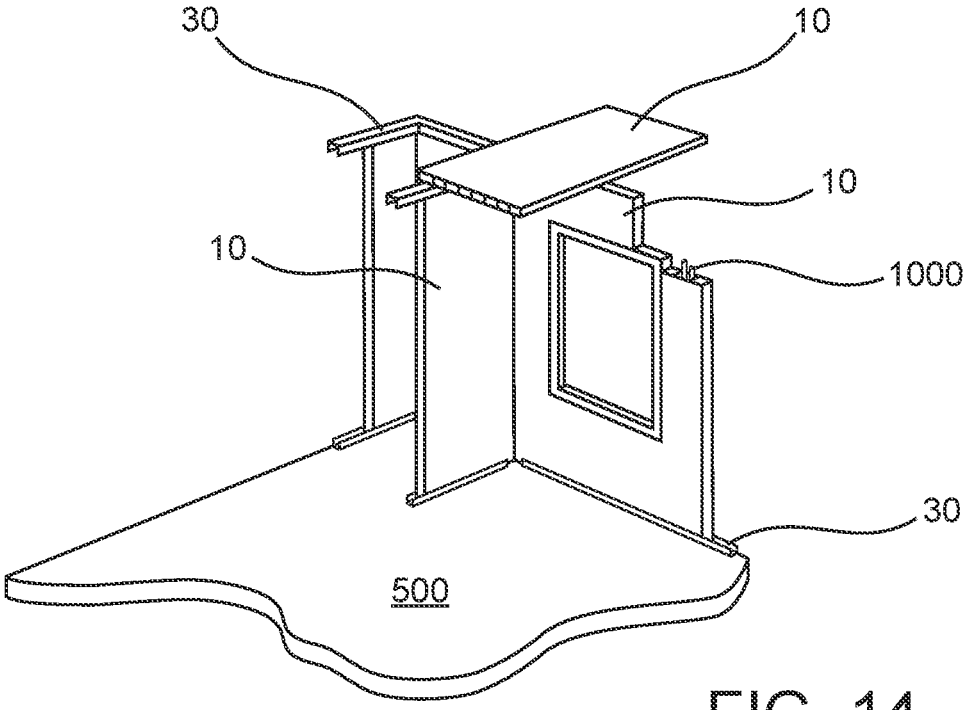
FIG. 14 is a partial cutaway perspective view showing various components assembled according to a system of the present invention.
Figure 15:
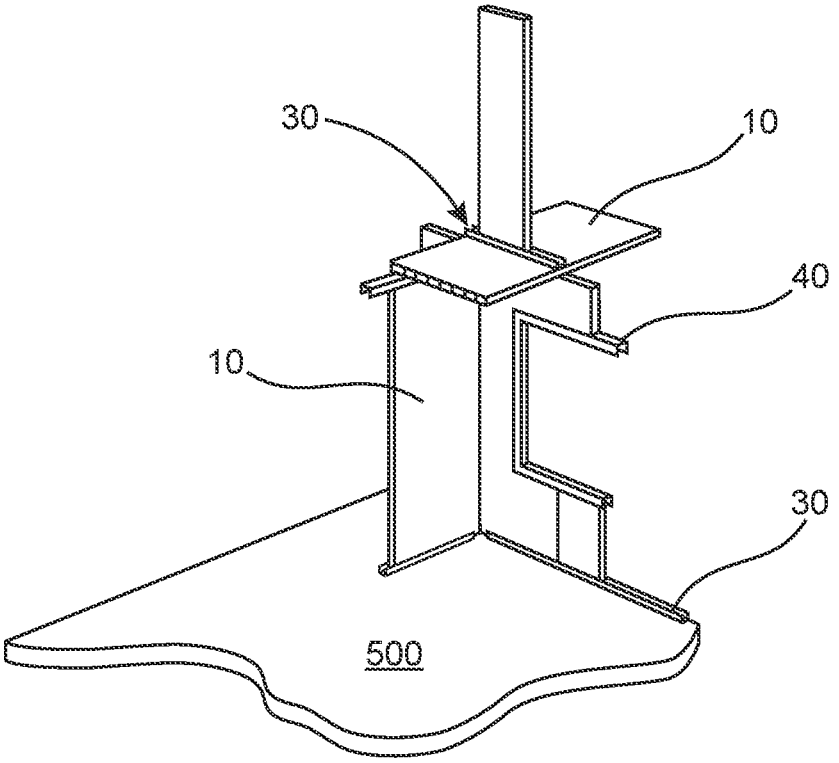
FIG. 15 is a partial cutaway perspective view showing various components assembled according to a system of the present invention.
Figure 16:
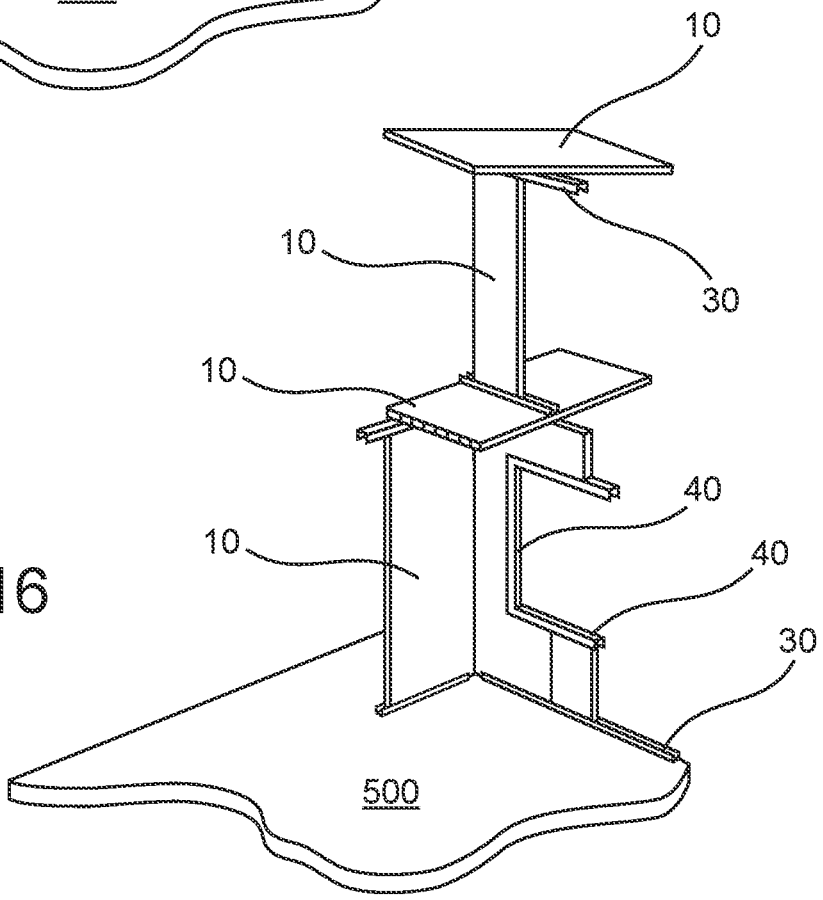
FIG. 16 is a partial cutaway perspective view showing various components assembled according to a system of the present invention.

FIG. 13 depicts a plurality of tracks 30 that have been fastened to the top of a plurality of vertically oriented panel members 10. In this regard, the structure is being prepared for the addition of a second story or flat roof. FIG. 14 shows a panel member 10 in a horizontal orientation employed as a first story ceiling and second story floor. As will be disclosed in further detail below, the horizontal panel member 10 is secured to the tracks 30 by fasteners, such as self-drilling screws, bolts, or rivets inserted through the external flange 32. In FIG. 15 it can be seen that another vertically oriented panel member 10' has been installed in the track 30 to create a second story wall. It may also be seen that the horizontally oriented panel member 10 is cantilevered outside of the structure, and may act as an awning or balcony. Finally, in FIG. 16, it can be seen that yet another panel member 10 has been mounted in an angled configuration in order to create a peak or gabled roof. It is secured to the vertically oriented panel member 10 via a track 30.

FIGS. 17 and 18 show detail views of a corner configuration according to one embodiment of the present invention. FIG. 17 depicts the interconnection between two adjoining panels 10 via a ninety degree corner bracket 20, along with the associated mating interface between the panel 10 ridge and valley members 13, 14 and the ridge and valley members 23, 24, of the corner bracket 10. FIG. 18 shows a plurality of tracks 30 fastened to a foundation 500 via fasteners 600 through the external flange 32. In certain scenarios, it may be desirable to use steel fasteners to penetrate a concrete foundation. However, when the track 30 is made of aluminum, galvanic corrosion may occur over time. Therefore, a neoprene gasket or washer may be used to insulate the fastener 600 from the track 30 to avoid electrical contact between the fastener 600 and the track 30. Additionally, a plurality of fasteners 600 are disposed through the corresponding mounting apertures in each of the tracks 30 and panels 10 in order to secure the panels 10 to the tracks 30.

Figure 19:
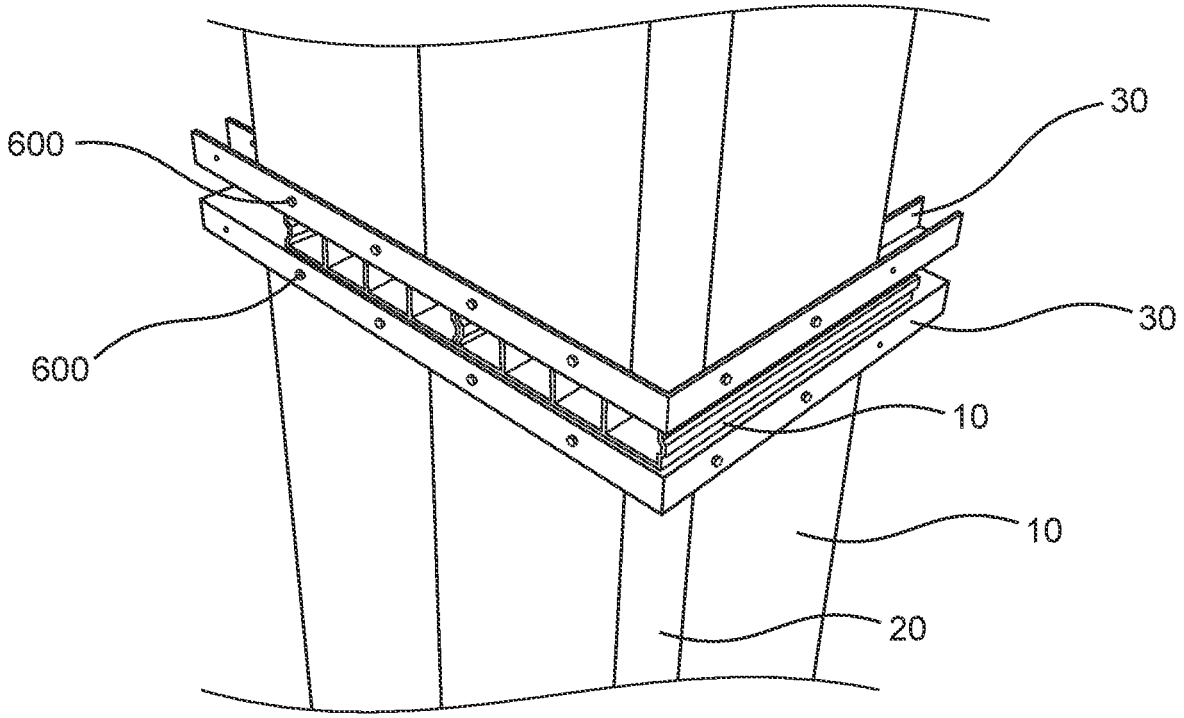
FIG. 19 is a detail partial cutaway perspective view showing various components assembled according to a system of the present invention.
Figure 20:
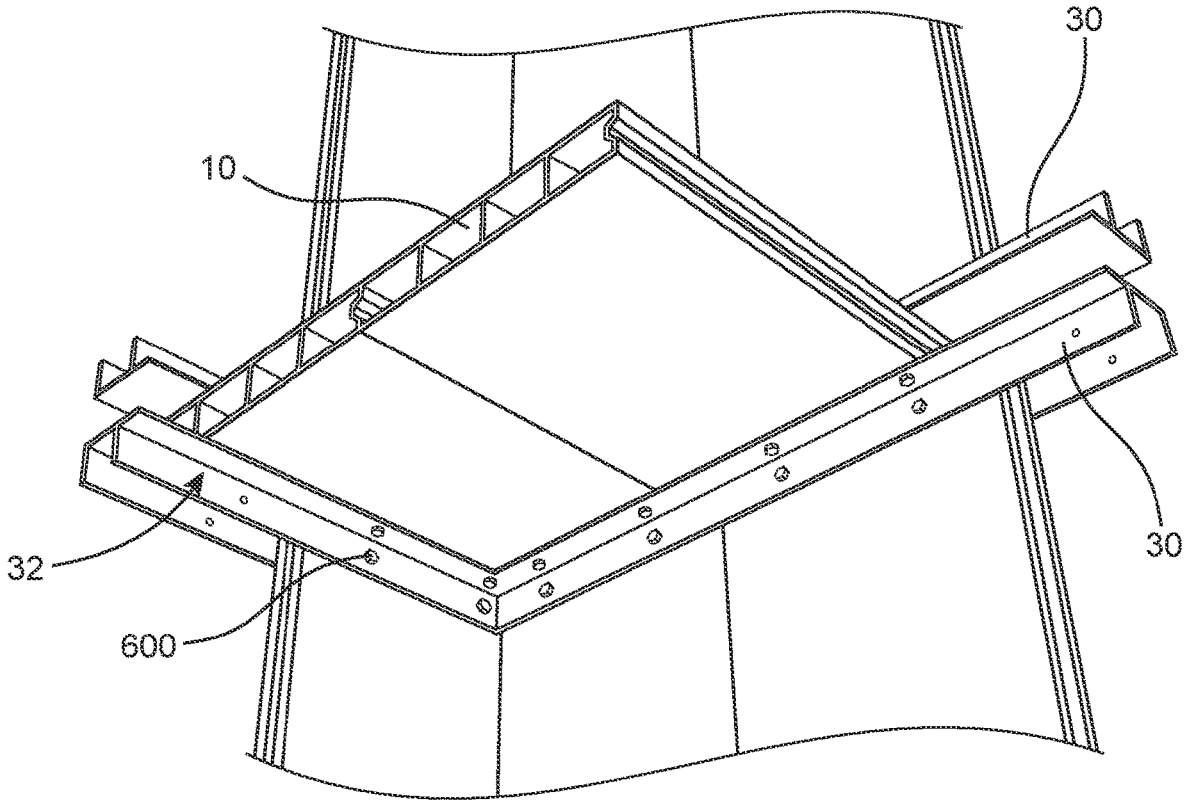
FIG. 20 is a detail partial cutaway perspective view showing various components assembled according to a system of the present invention.

FIGS. 19 and 20 provide a detail view of the system of the present invention utilized to construct a multi-story building. As such a plurality of panels 10 are utilized to construct the walls as well as the ceiling of the first floor and floor of the second floor. The panel 10 serving as a ceiling/floor is sandwiched between two tracks 30 disposed on the panels 10 serving as walls. In this scenario, fasteners 600 are disposed through the external flanges 32 of the tracks and into the panel 10 serving as a floor. Therefore, the panel serving as a floor can be securely retained in place. In certain embodiments, it may be desirable to use self-tapping screws, bolts, or rivets for this purpose as the panels 10 may not have mounting apertures appropriately placed.

Figure 21:
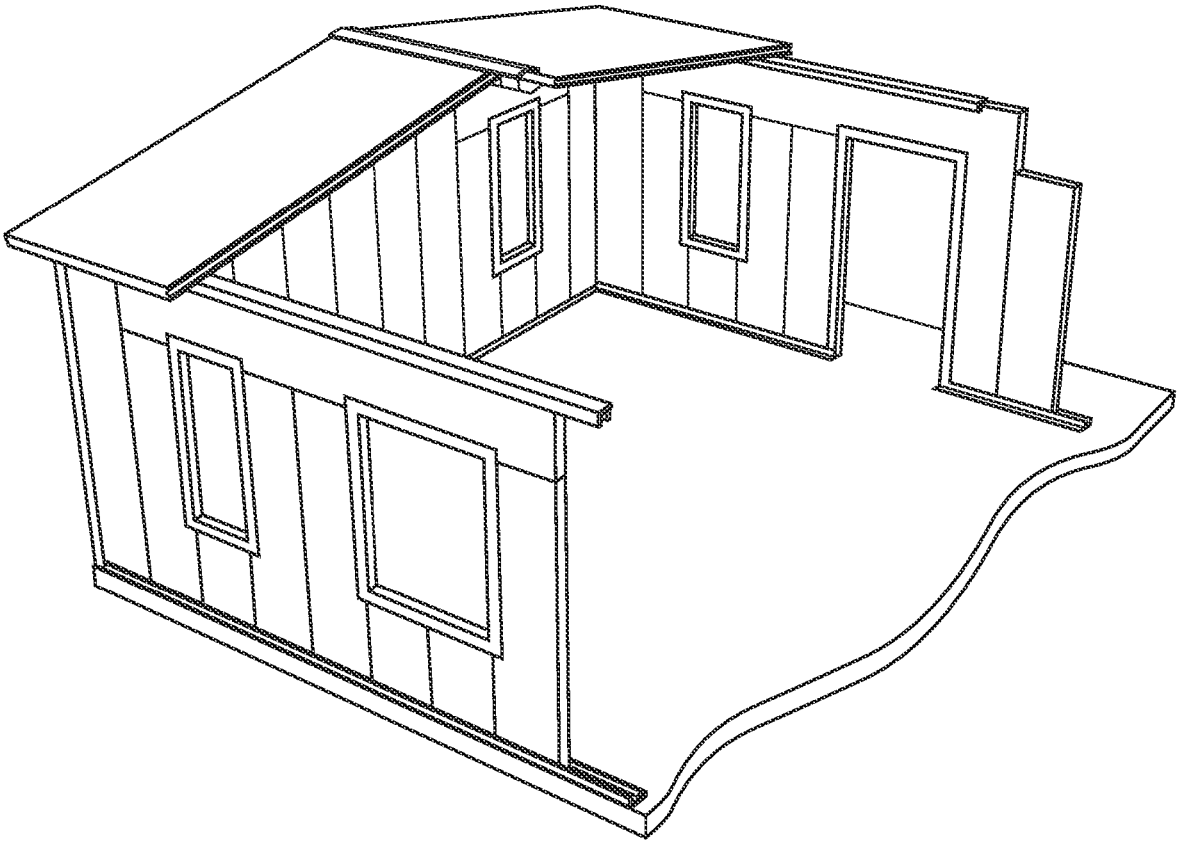
FIG. 21 is a partial cutaway perspective view showing various components assembled according to a system of the present invention.
Figure 21A:
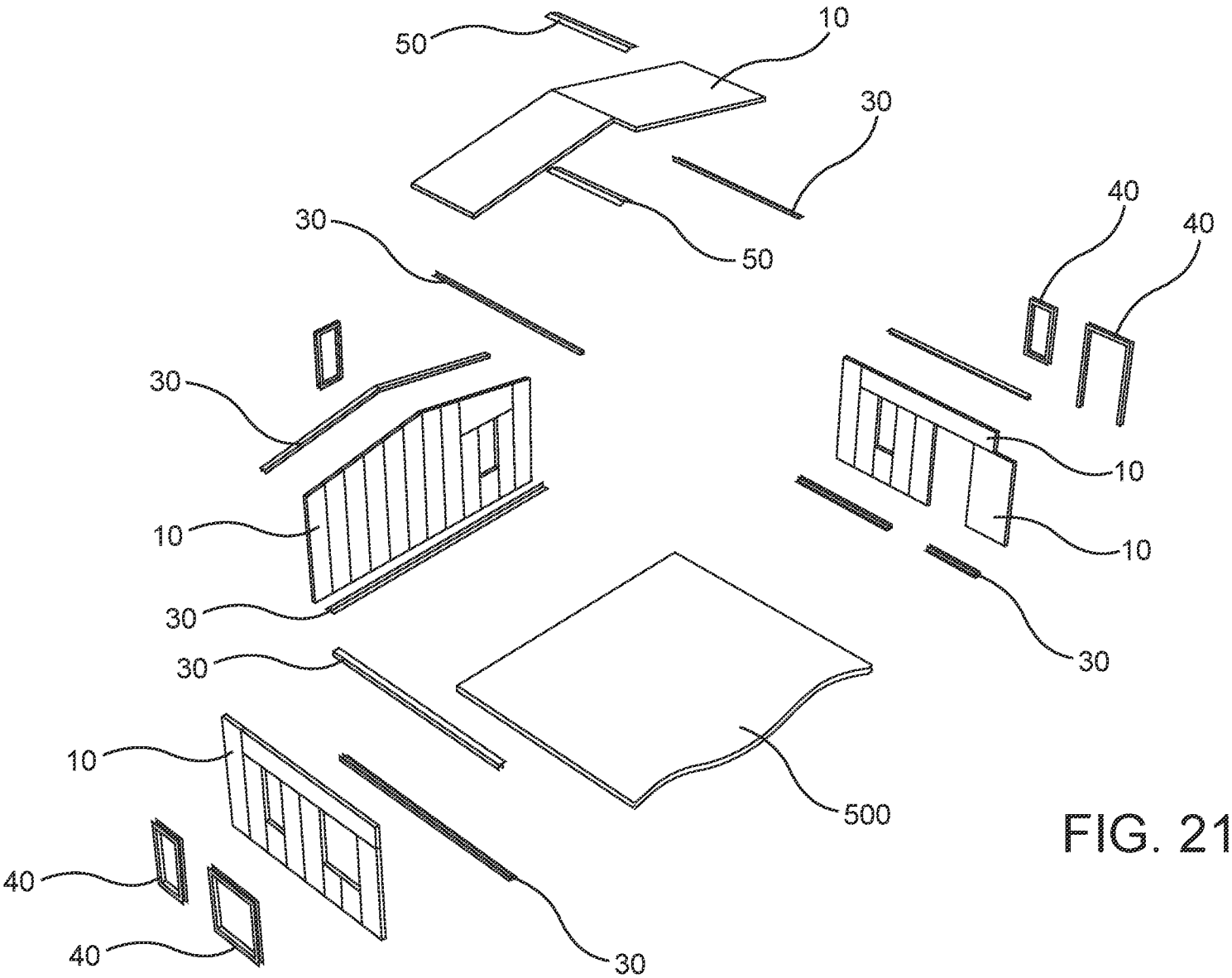
FIG. 21A is an exploded view of FIG. 20.

FIGS. 21 and 21A show a partially completed structure in both constructed and exploded form for further exemplification. As can also be seen, several panel members 10 are adjoined together to create a gabled roof. Thus, two ridge plates 50 are employed to facilitate the connection of each panel 10 at the ridge of the roof.

Figure 22:
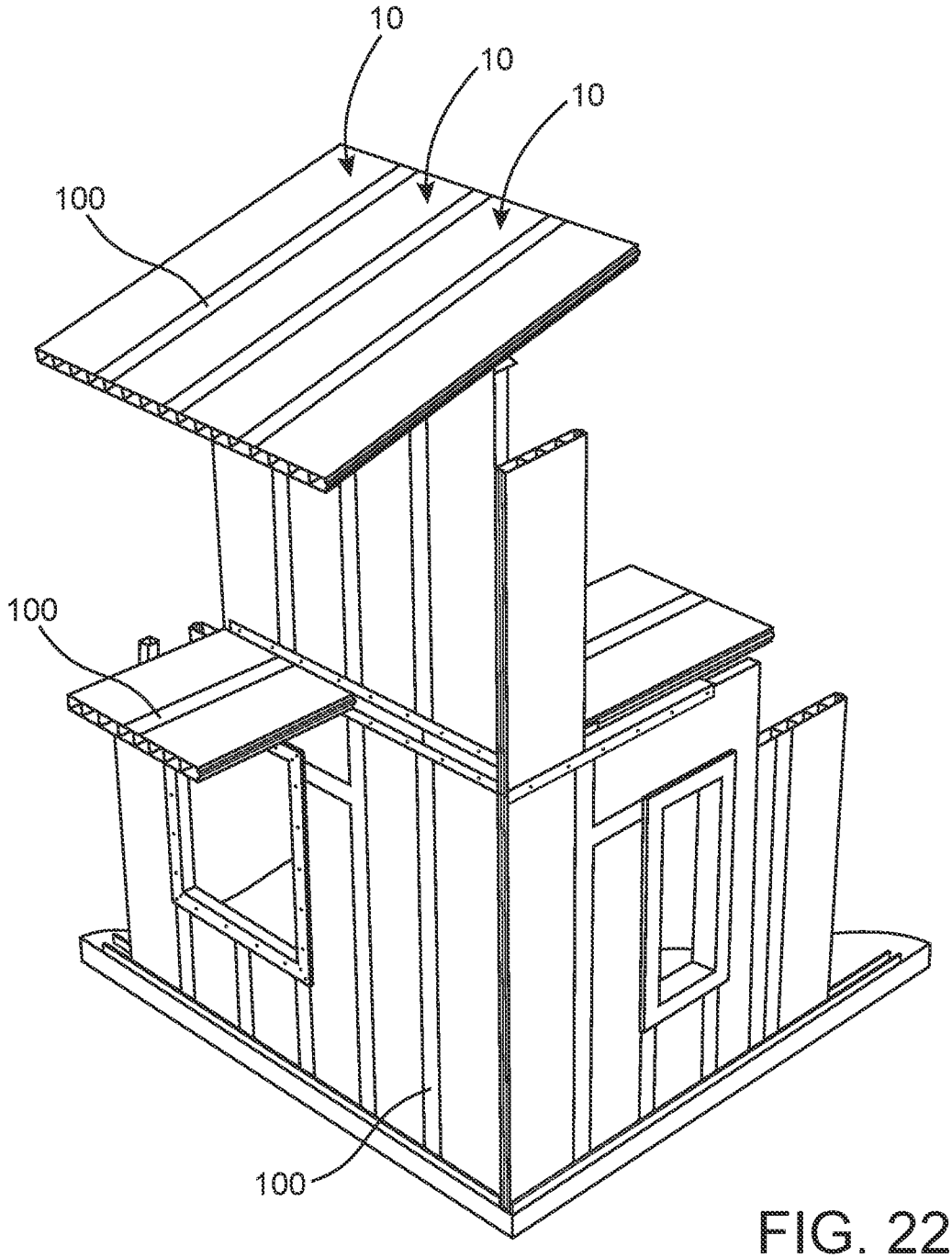
FIG. 22 is a partial cutaway perspective view showing various components assembled according to a system of the present invention.
Figure 23:
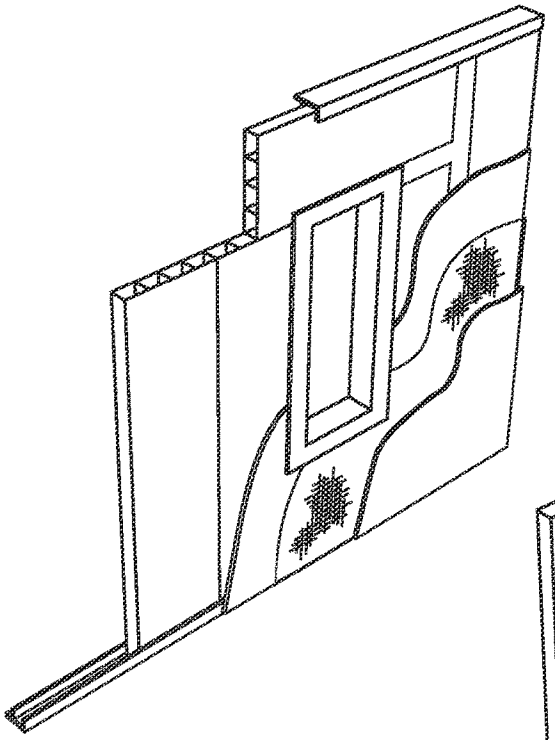
FIG. 23 is a partial cutaway perspective view showing various components assembled according to a system of the present invention.
Figure 24:
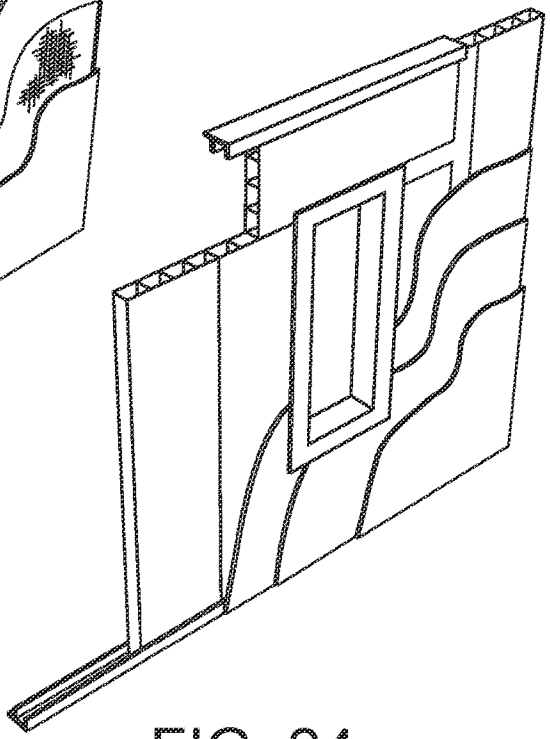
FIG. 24 is a partial cutaway perspective view showing various components assembled according to a system of the present invention.

FIG. 22 depicts a partially completed structure utilizing a membrane 100 between consecutive panels 10. In a preferred embodiment, the membrane 100 is self-adhering and water resistant. Therefore, particularly with regard to roof construction, the system of the present invention can be employed where resistance to water intrusion is a concern. As can be seen, the membrane 100 may be applied at the intersection of any two consecutive panels 10 in order to ensure that water does not weep between the crevice formed therein. The Figure also shows that panel members 10 may be employed in a cantilevered configuration to create awnings and balconies. Caulking may be employed in addition to, or in lieu of, the membrane 100, particularly between adjoining panels 10.

Figure 25:
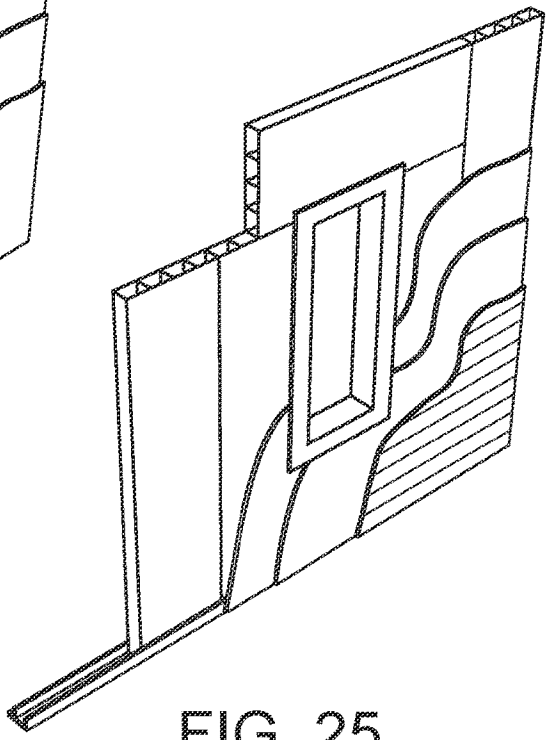
FIG. 25 is a partial cutaway perspective view showing various components assembled according to a system of the present invention.
Figure 28:
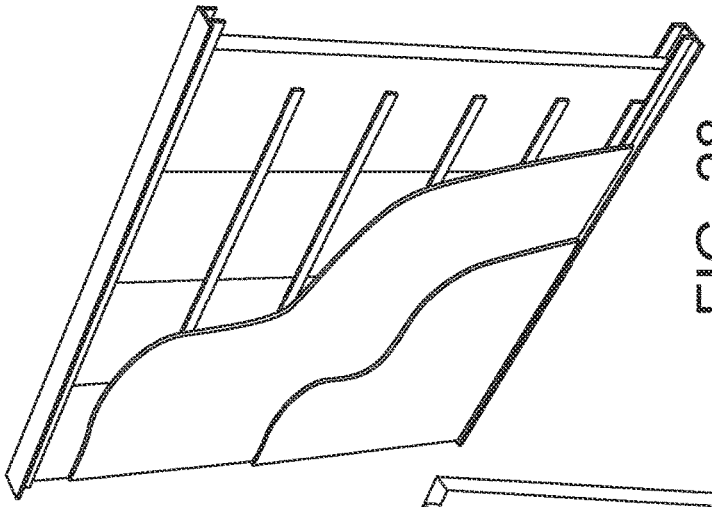
FIG. 28 is a partial cutaway perspective view showing various components assembled according to a system of the present invention.
Figure 27:
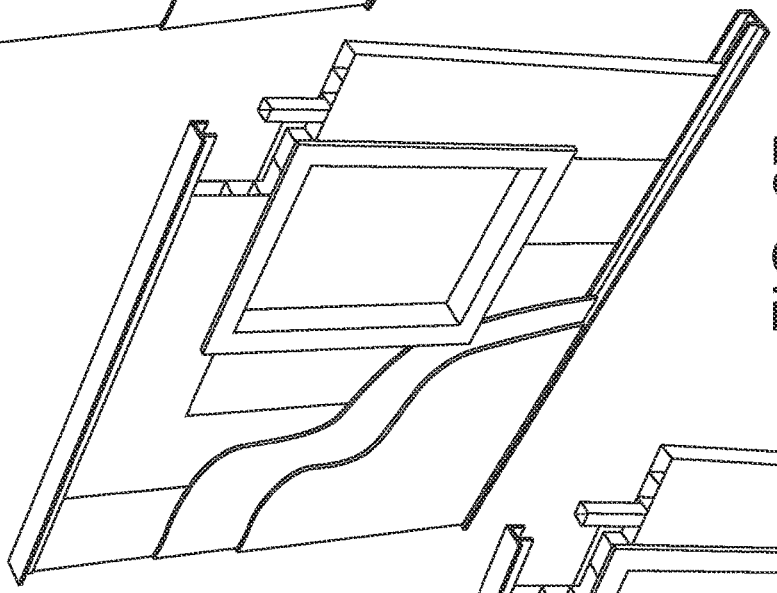
FIG. 27 is a partial cutaway perspective view showing various components assembled according to a system of the present invention.
Figure 26:
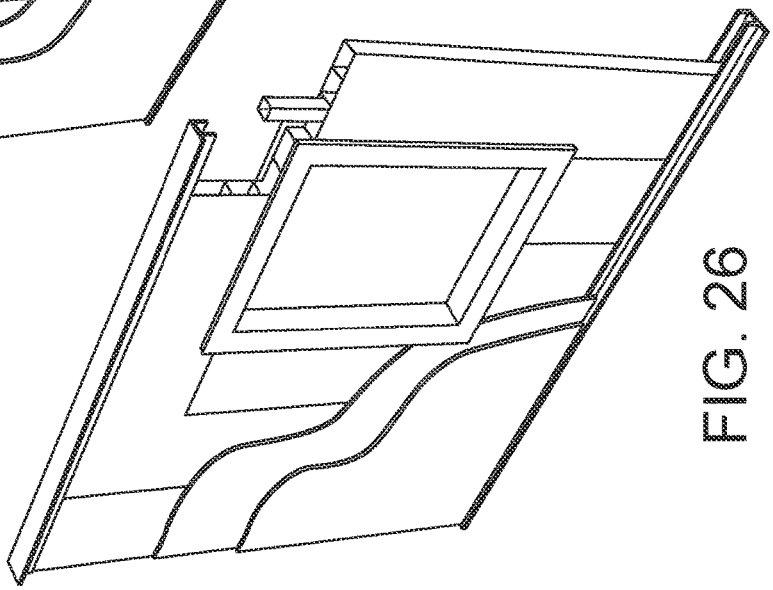
FIG. 26 is a partial cutaway perspective view showing various components assembled according to a system of the present invention.
Figure 29:
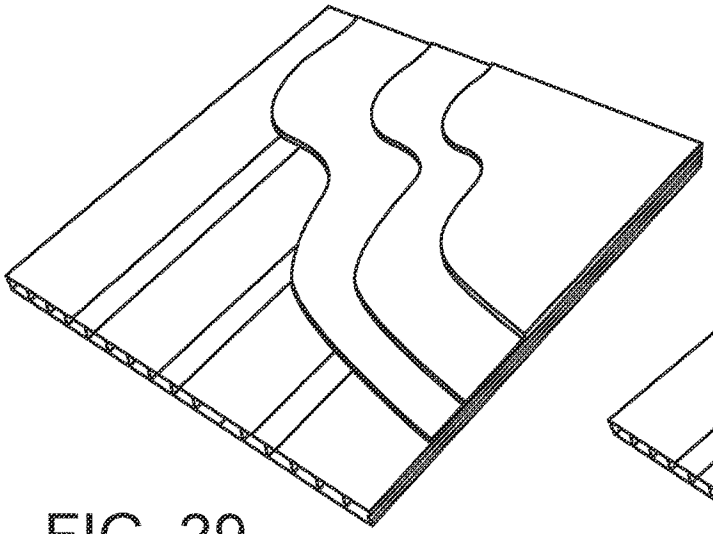
FIG. 29 is a partial cutaway perspective view showing various components assembled according to a system of the present invention.
Figure 30:
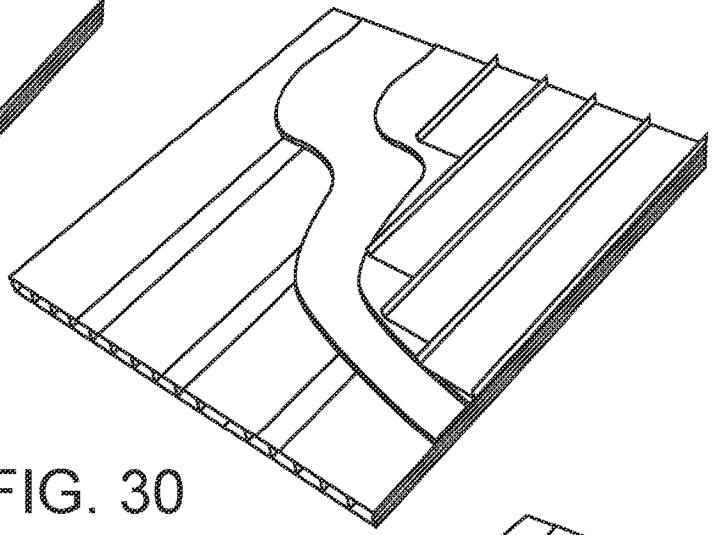
FIG. 30 is a partial cutaway perspective view showing various components assembled according to a system of the present invention.

FIGS. 23 through 28 show how traditional interior and exterior finishes can be used in conjunction with the system by applying them on top of the panel members 10. By way of non-limiting example, the exterior finishes may include sheathing, housewrap/mesh, and stucco (FIG. 23), rigid insulation, fiberglass mesh, and stucco (FIG. 24), or sheathing, high-density polyethylene paper, and siding (FIG. 25). Non-limiting examples for interior finish include drywall and paint (FIG. 26), cement board and stucco (FIG. 27), and furring strips, cement board, and wall tiles (FIG. 28).

Figure 31:
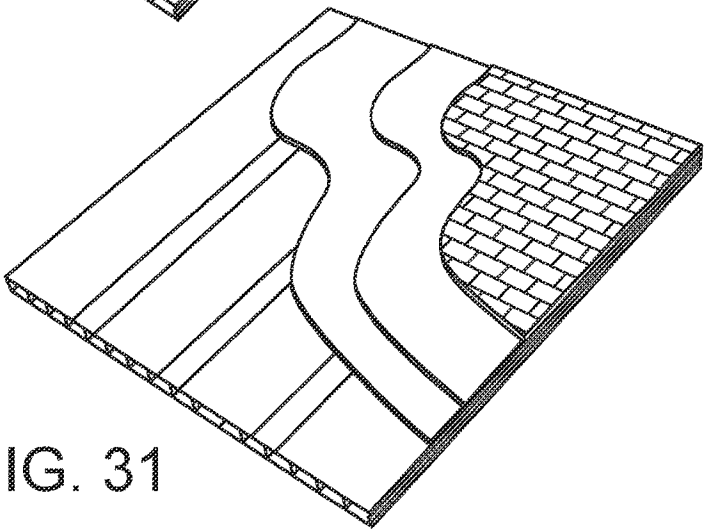
FIG. 31 is a partial cutaway perspective view showing various components assembled according to a system of the present invention.
Figure 32:
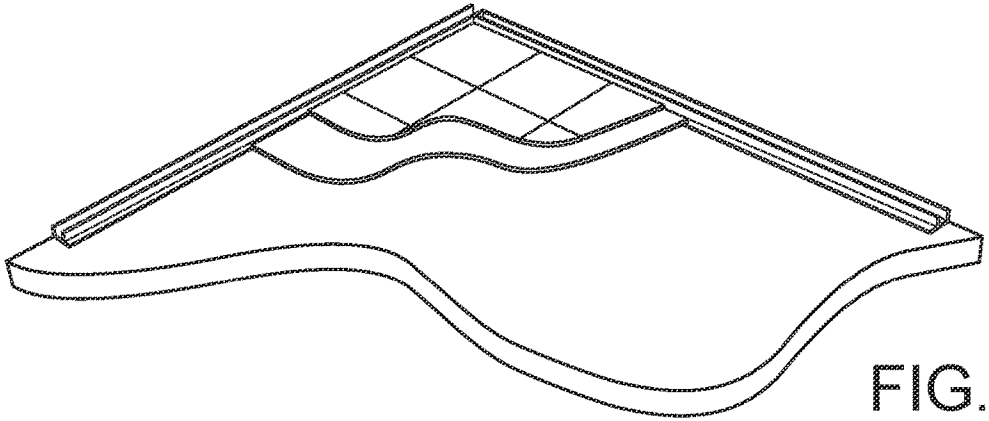
FIG. 32 is a partial cutaway perspective view showing various components assembled according to a system of the present invention.
Figure 33:
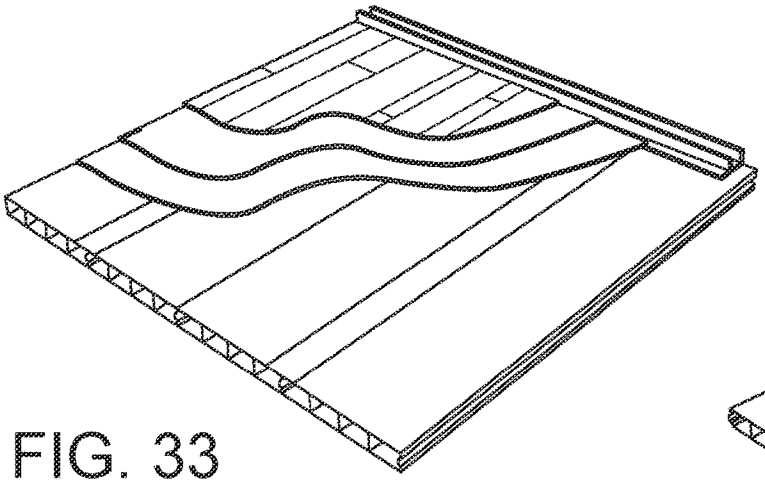
FIG. 33 is a partial cutaway perspective view showing various components assembled according to a system of the present invention.
Figure 34:
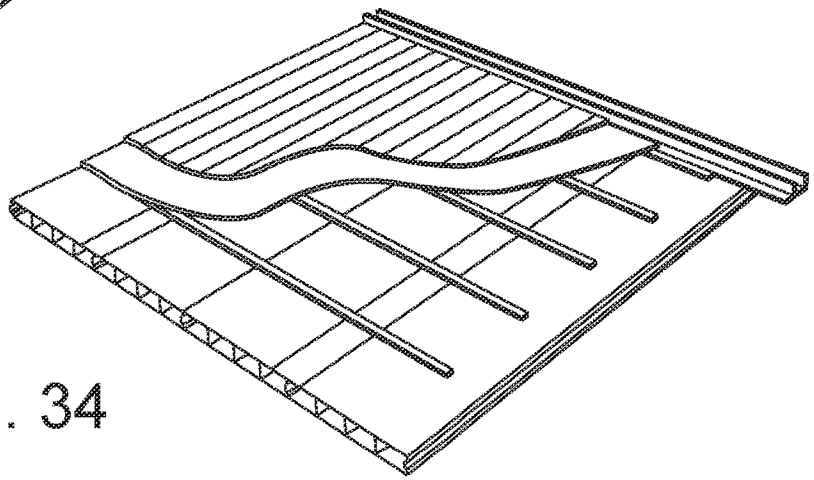
FIG. 34 is a partial cutaway perspective view showing various components assembled according to a system of the present invention.

FIGS. 29 through 34 show how traditional roof and floor finishes may be used in conjunction with the system. By way of non-limiting example, such roof finishes may include rigid insulation, sheathing, and TPO (FIG. 29), rigid insulation, a moisture barrier, and metal tiles (FIG. 30), or rigid insulation, plywood, and asphalt shingles (FIG. 31). Flooring finishes may include, by way of non-limiting example building paper/mesh and tile flooring (FIG. 32), plastic barrier, foam pad, and laminate wood (FIG. 33), or furring strips, foam padding, and hard wood (FIG. 34).

Figure 35:
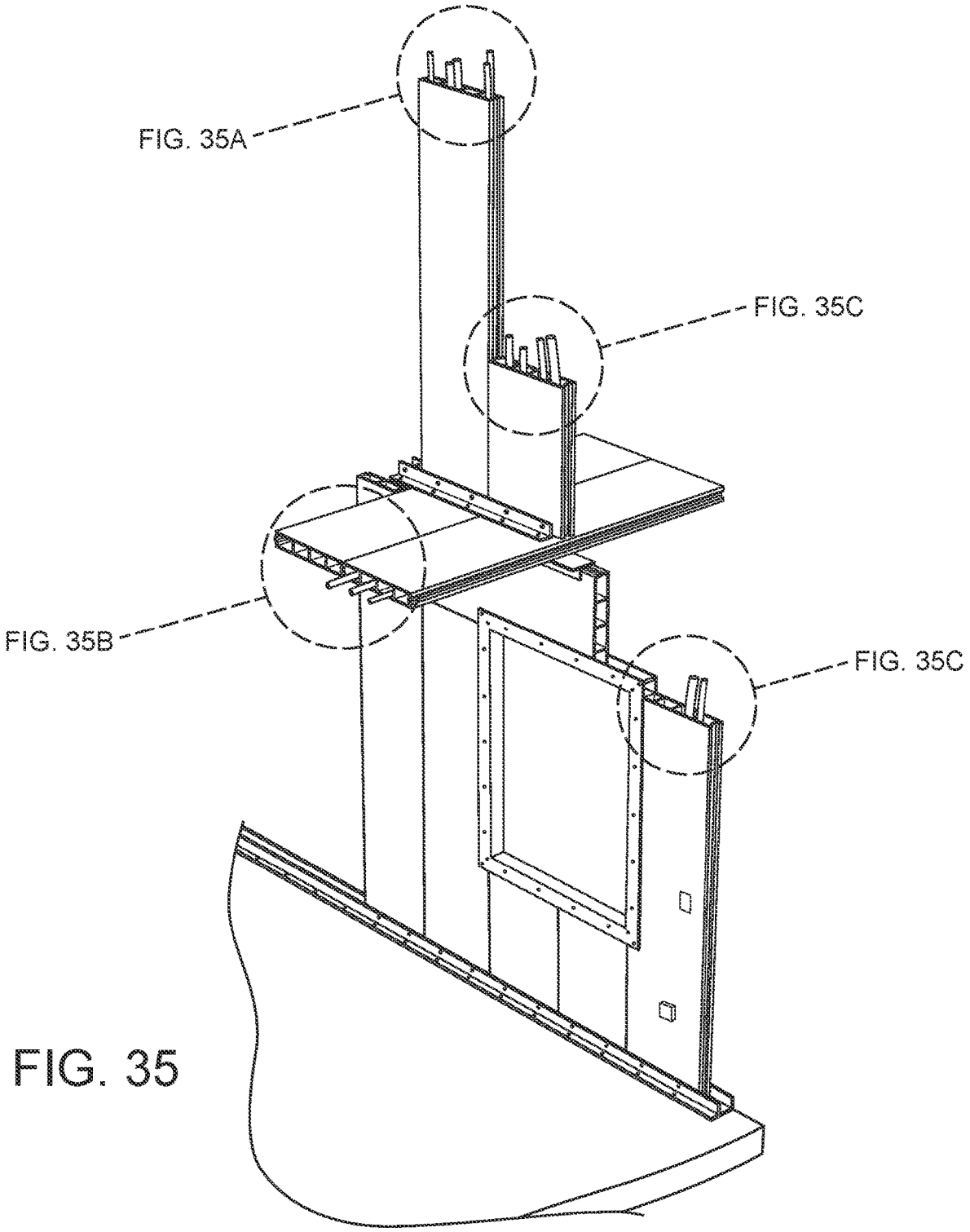
FIG. 35 is a partial cutaway perspective view showing various components assembled according to a system of the present invention.
Figure 35A:
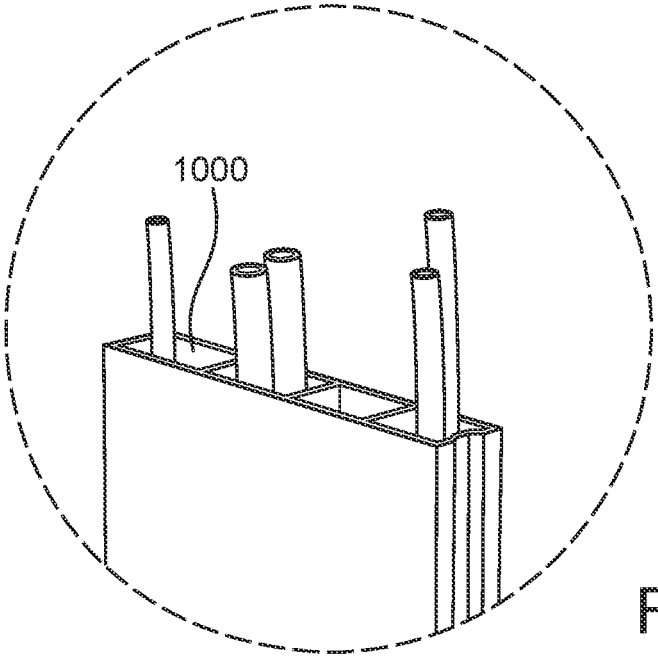
FIG. 35A is a detail view of the embodiment presented in FIG. 35.
Figure 35B:
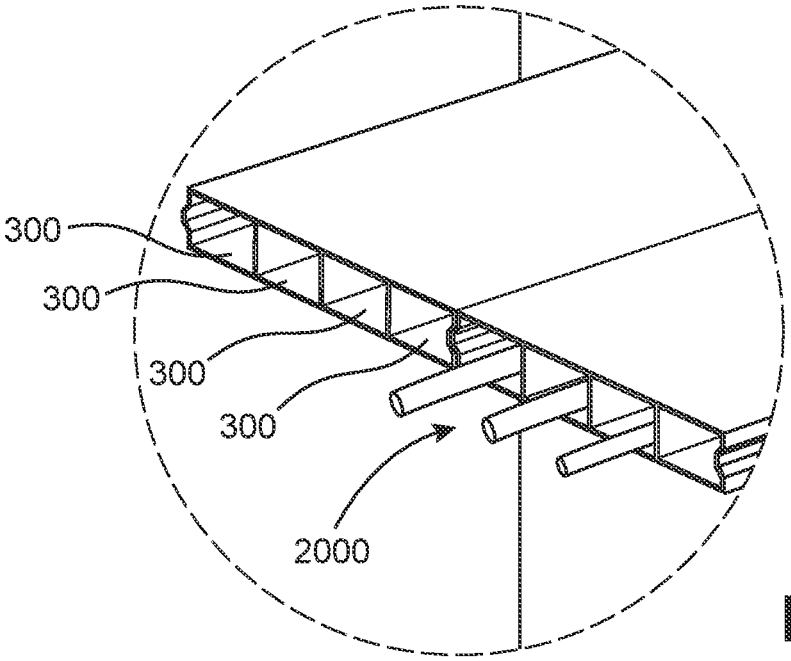
FIG. 35B is a detail view of the embodiment presented in FIG. 35.
Figure 35C:
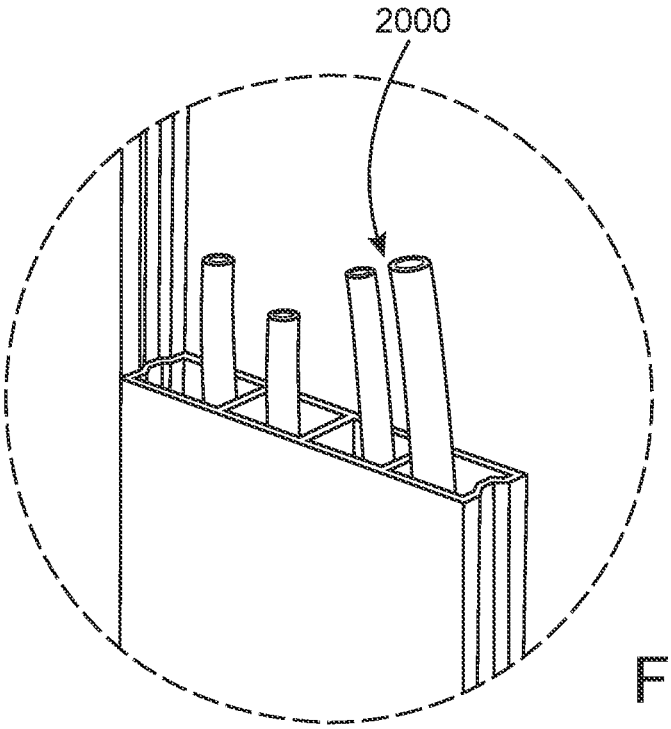
FIG. 35C is a detail view of the embodiment presented in FIG. 35.
Figure 35D:
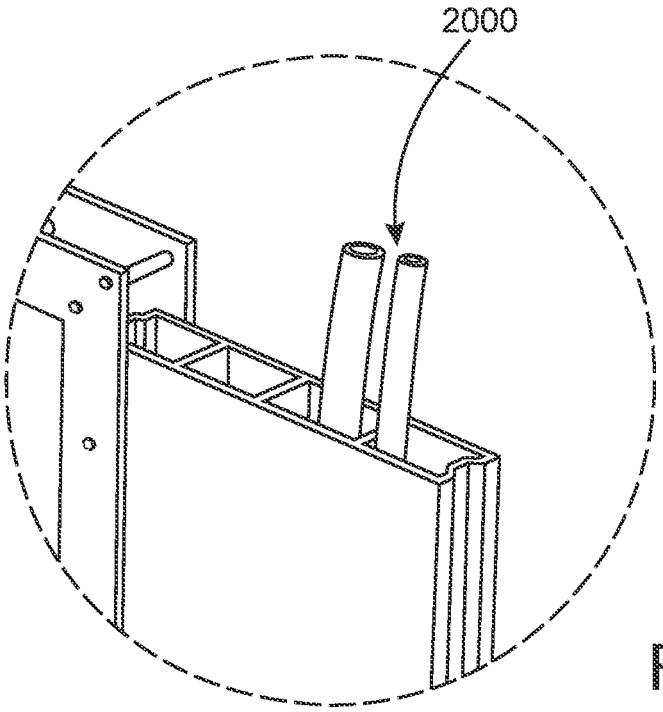
FIG. 35D is a detail view of the embodiment presented in FIG. 35.

FIGS. 35 through 35D depict how traditional mechanical, electrical, and plumbing lines may be integrated with the present invention. In particular, water lines 1000 and electrical conduits 2000 may be simply routed through the channels 11 within the panels 10. Additionally, the channels 11 may be used as air conditioning ducts 300 as shown in FIG. 35B.

Figure 38:
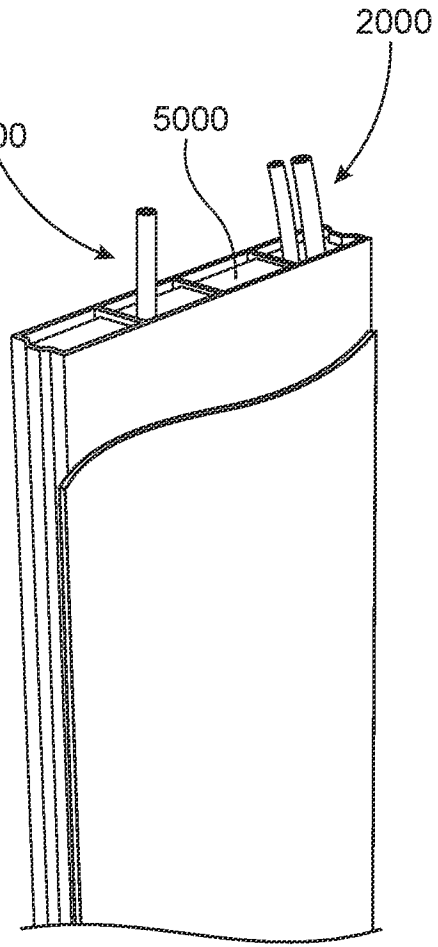
FIG. 38 is a partial cutaway perspective view showing various components assembled according to a system of the present invention.
Figure 37:
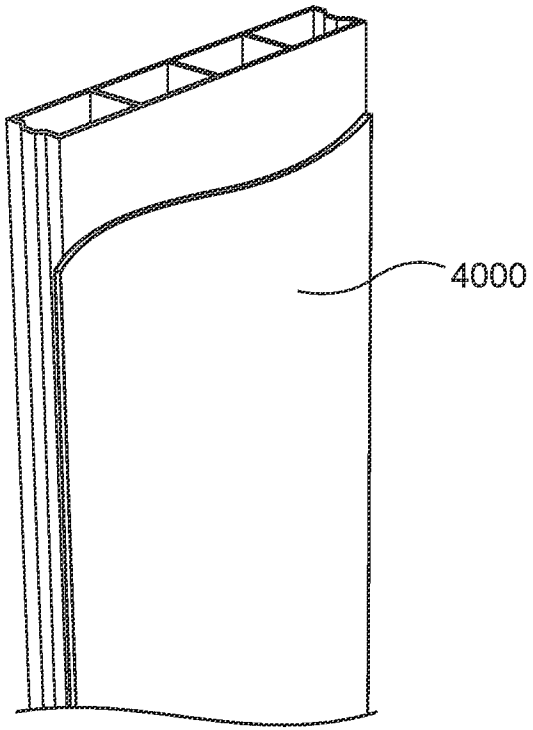
FIG. 37 is a partial cutaway perspective view showing various components assembled according to a system of the present invention.
Figure 36:
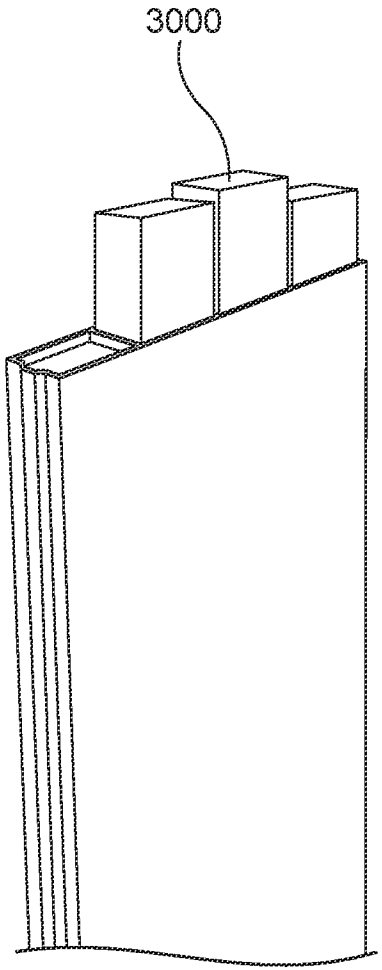
FIG. 36 is a partial cutaway perspective view showing various components assembled according to a system of the present invention.
Figure 39:
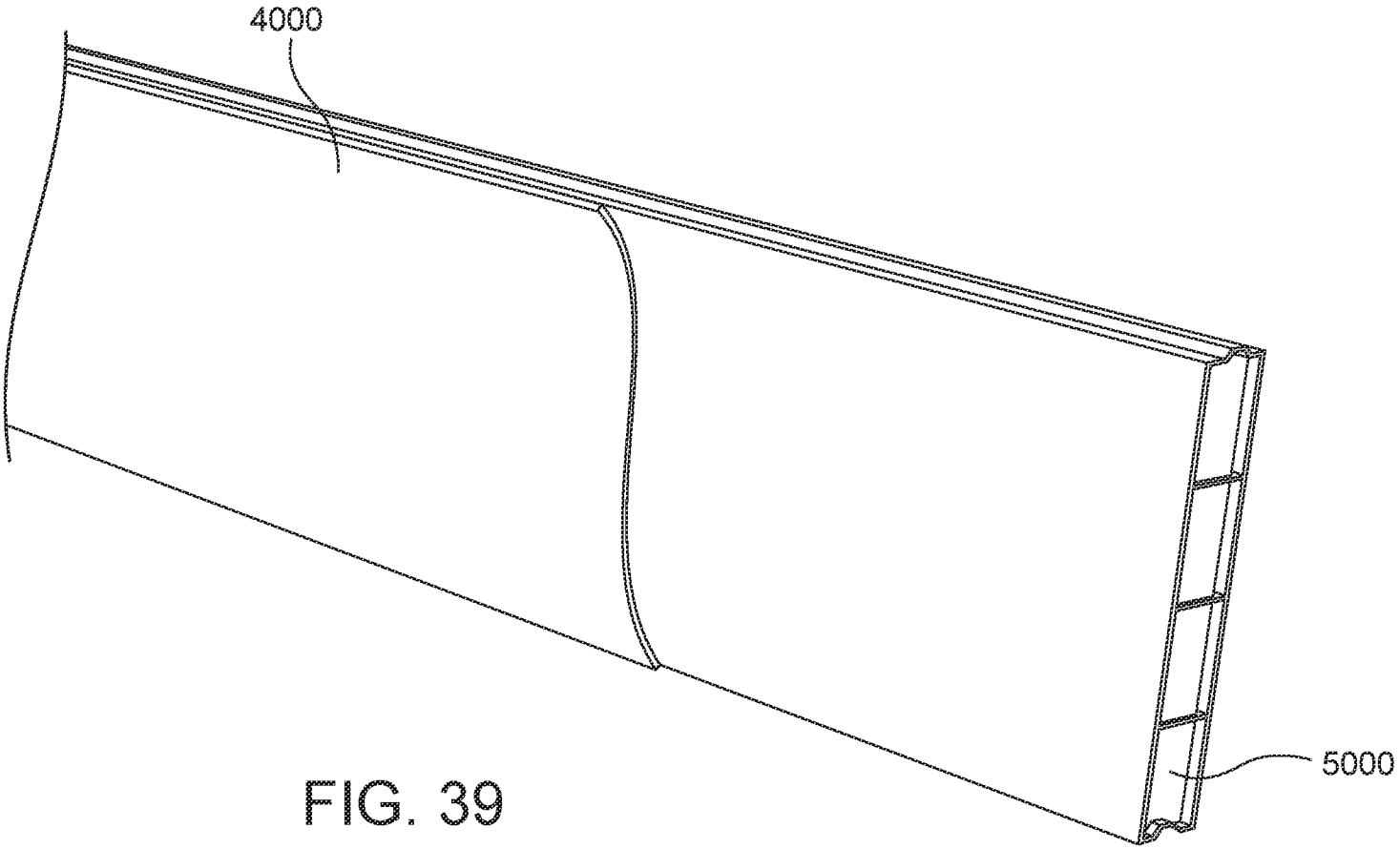
FIG. 39 is a partial cutaway perspective view showing various components assembled according to a system of the present invention.
Figure 40:
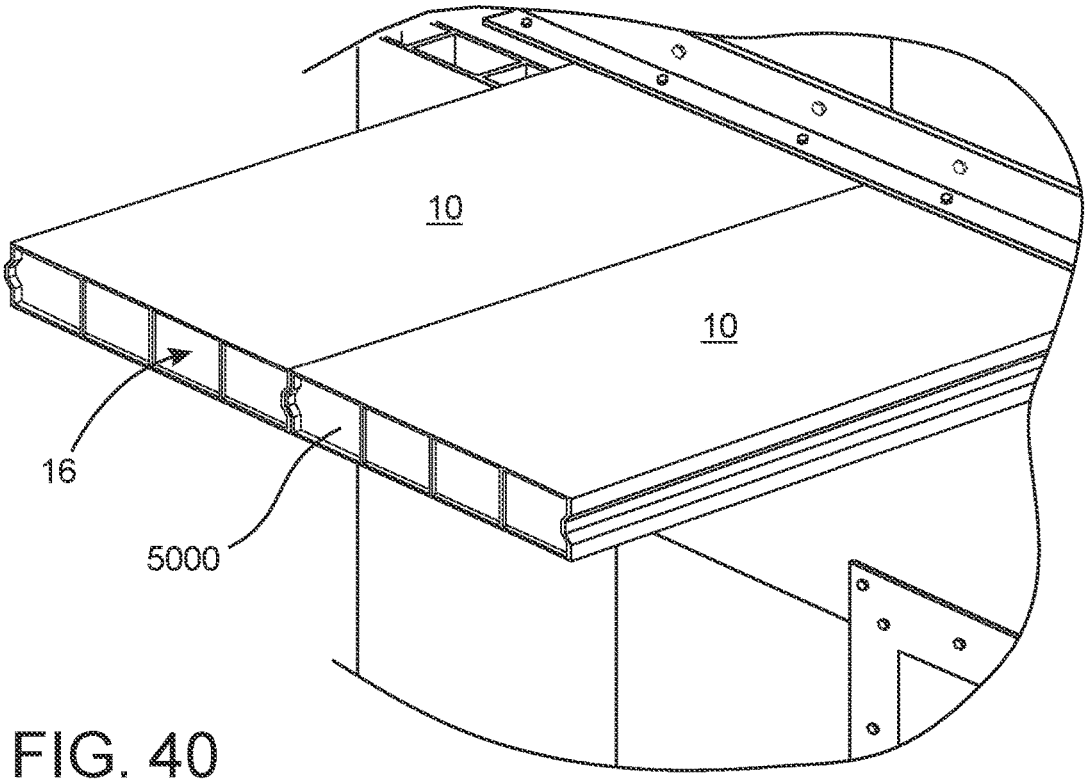
FIG. 40 is a partial cutaway perspective view showing various components assembled according to a system of the present invention.
Figure 41:
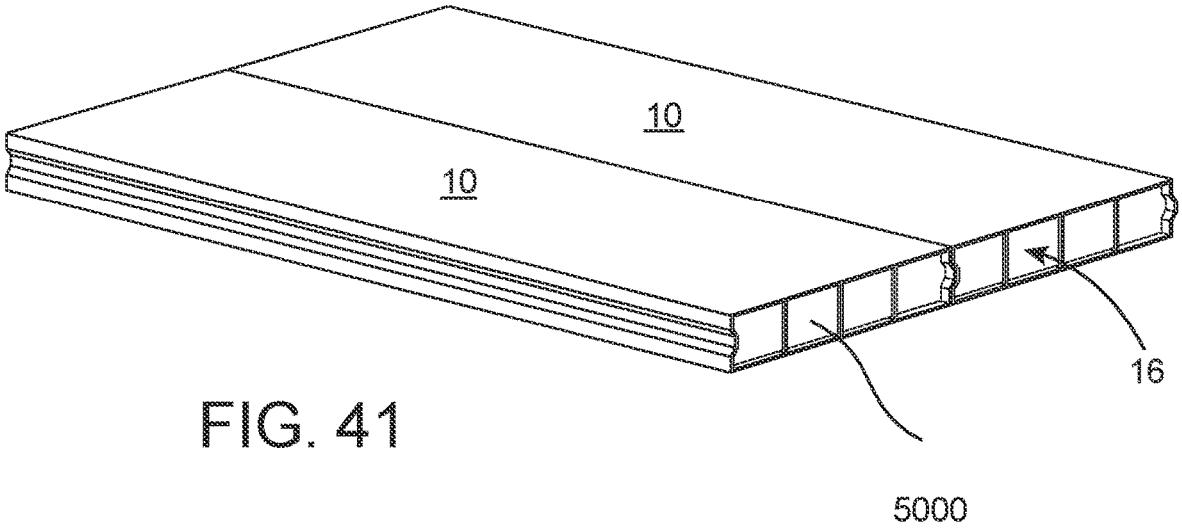
FIG. 41 is a partial cutaway perspective view showing various components assembled according to a system of the present invention.

FIGS. 36 though 41 show various insulation options that may be applied to the surface of a panel or disposed within the channel 11 of a panel 10. FIG. 36 is a depiction of pre-formed or pre-cut insulation 3000, such as foam, that may be slid into the channels 11 during construction. FIG. 37 depicts a spray insulation 4000 that may be applied to the face 12 of a panel 10. FIG. 38 depicts an injection foam insulation 5000 that can be utilized in channels 11 where electrical or plumbing lines are utilized. FIGS. 40 and 41 show that the insulation may be added in-situ due to the open ends 16 of the panels 10.

Figure 42:
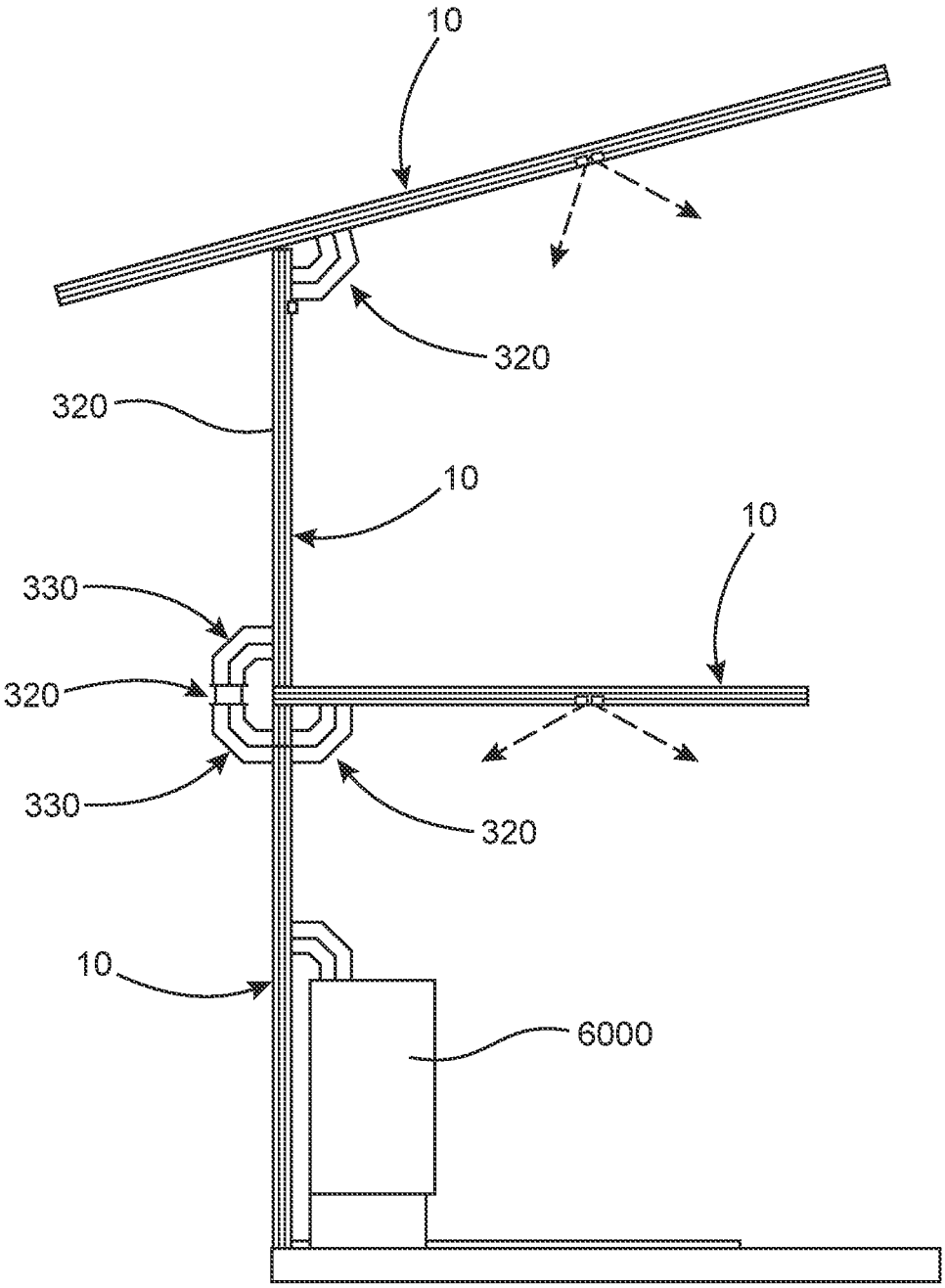
FIG. 42 is a partial cutaway perspective view showing various components assembled according to a system of the present invention.
Figure 43:
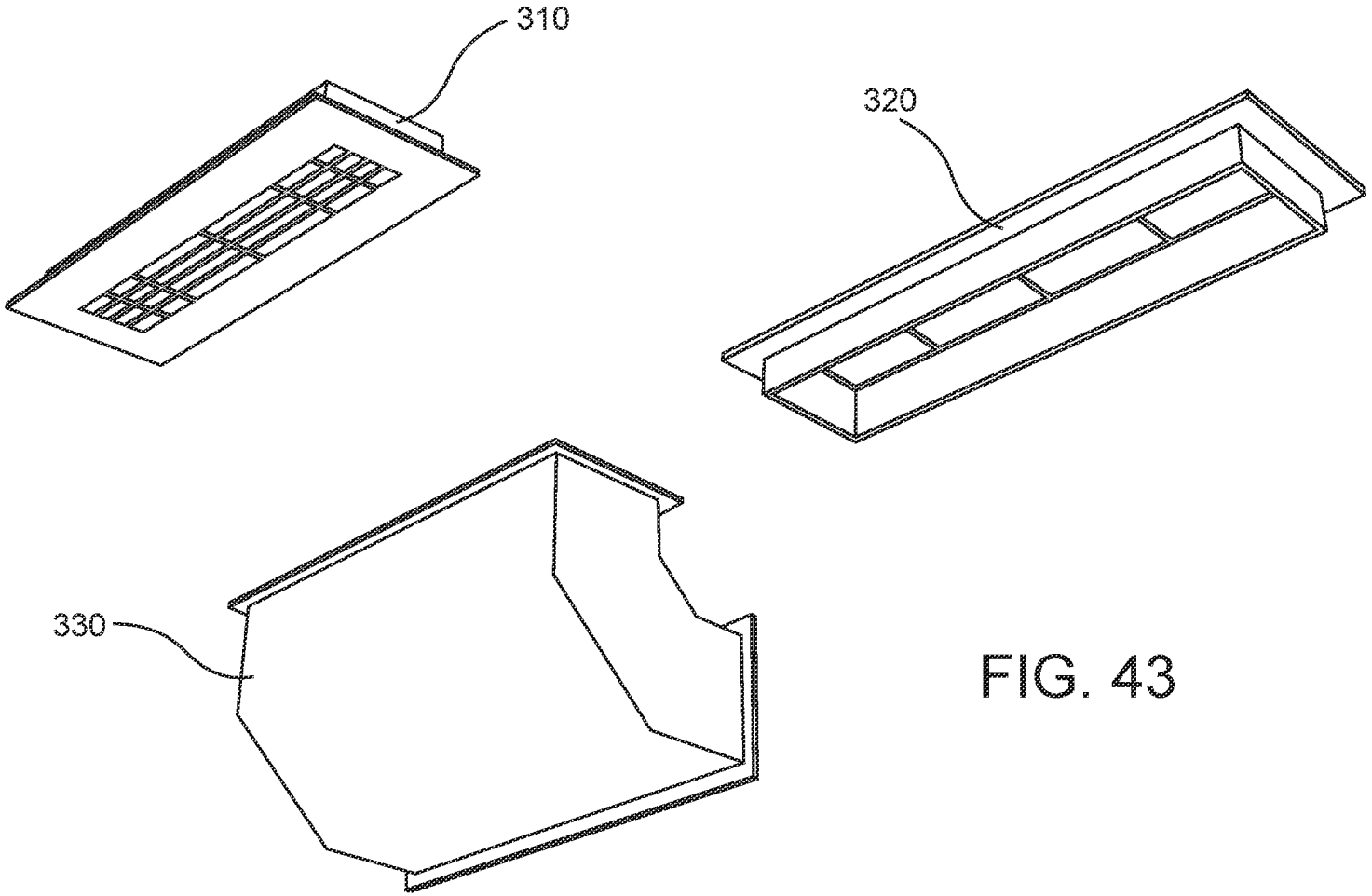
FIG. 43 is a perspective view of several components according to one embodiment of the present invention.
Figure 44:
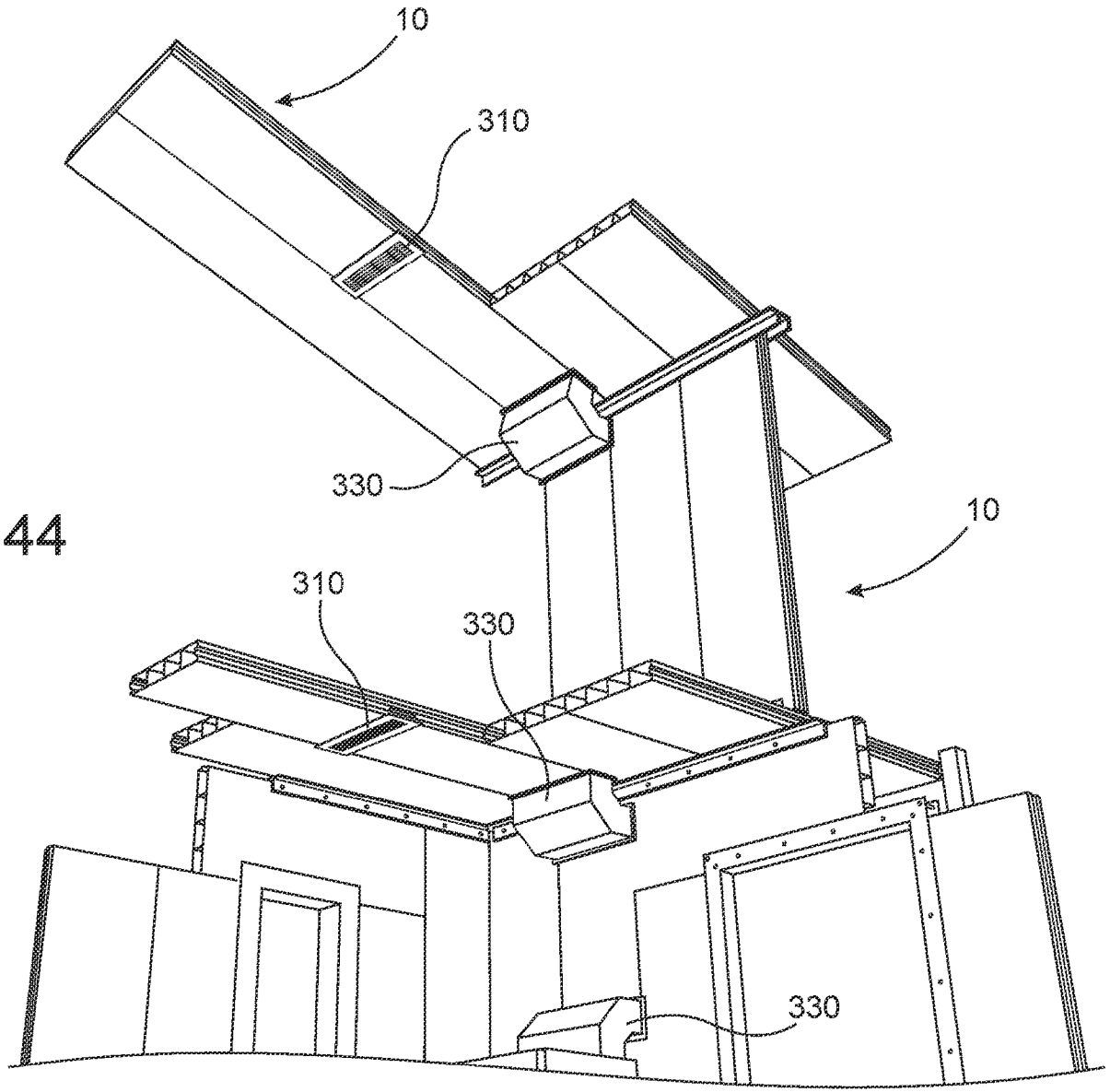
FIG. 44 is a partial cutaway perspective view showing various components assembled according to a system of the present invention.

FIGS. 42 and 44 provides a schematic depiction of how the present invention may be utilized to route cooled air more efficiently from an air conditioning unit via the channels 11 of the panels 10. FIG. 43 depicts additional components to facilitate this aim. As can be seen, connectors 330 and elbows 320 may be used to route the cooled air from the air conditioning unit 6000 into one or more channels 11 and between channels 11 in consecutive panels. While it may be possible to simply provide apertures in the tracks 30 (and ends of panels 10) to facilitate air flow between successive panels 10 and tracks 30, that may hinder construction of the overall structure. The elbows 320 and connectors 330 allow for implementation of this benefit after construction. Diffuser grills 310 can also be employed to introduce cooled air into the room via the wall panels 10 or ceiling panels 10.

Figure 45:
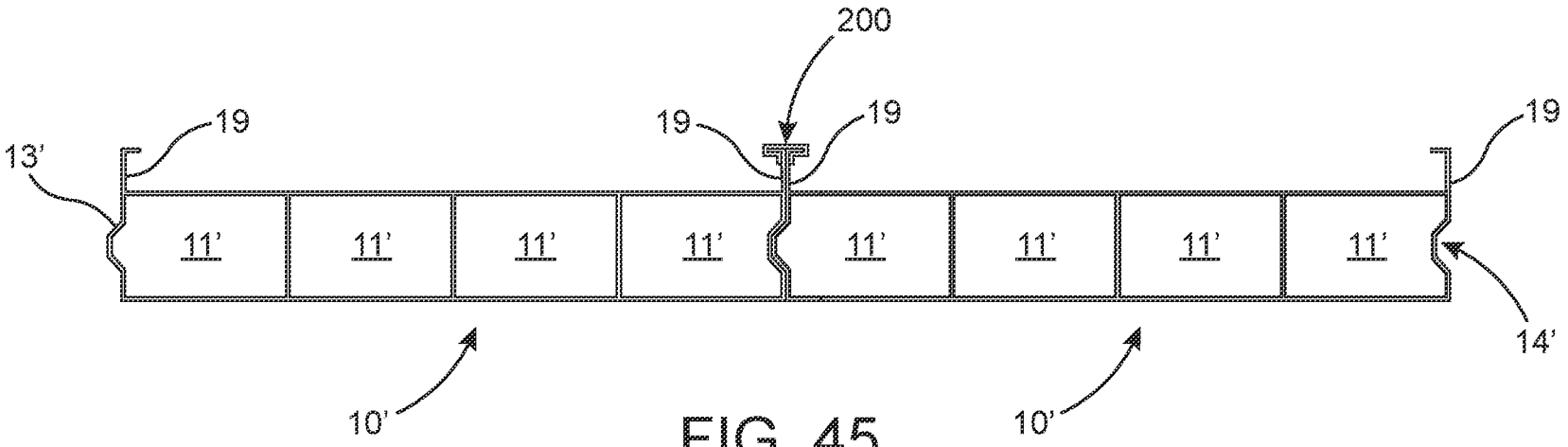
FIG. 45 is a section view of two panel members according to another embodiment of the presentation invention.
Figure 46:
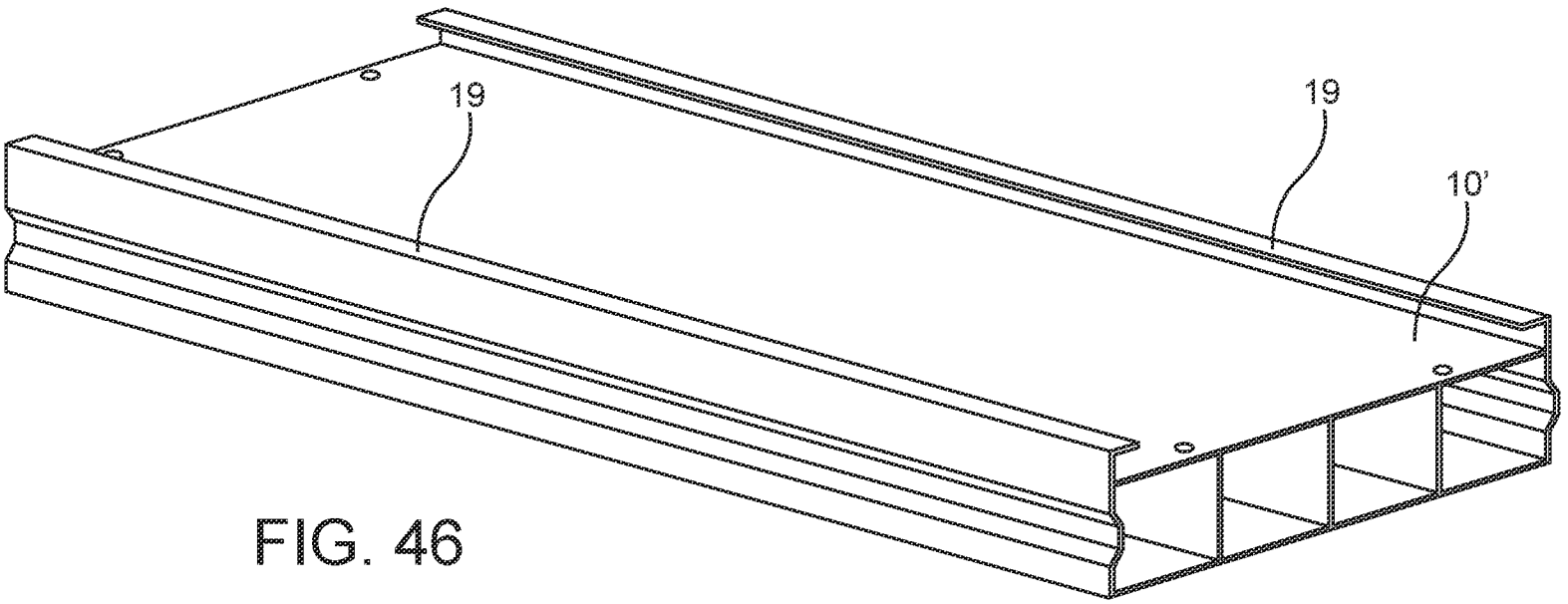
FIG. 46 is a perspective view of a panel member according to the embodiment of FIG. 45.

Turning to FIGS. 45 and 46 another embodiment of a panel 10' is depicted therein. This embodiment finds particular suitability for utilizing the panel 10' as a roof member. As can be seen, the panel member 10' contains the same structure as in previous embodiments, including opposite faces 12' spaced by a plurality of webs 15', which at least partially define channels 11' traversing the open ends 16' of the panel 10'. The panel 10' also includes a ridge member 13' and a valley member 14'. The additional structure of the present embodiment is a flanged extension 19 traversing the length of the panel 10. Each flanged extension 19 includes a flange which extends inwardly toward the panel 10'. As can be seen in FIG. 45, when two panels 10' are adjoined next to one another, the flanged extension 19 abut one another. A cap 200 which encompasses the flange portion of the flanged extension can then be disposed about both flanged extensions 19, thereby locking the two panels 10' together and creating a water-resistant seal. In this fashion, the assembly approximates the typical crimped construction of existing metal roofs. Utilizing this embodiment of the present invention avoids the need for additional waterproofing steps, such as membranes and caulking, when the panels 10' are employed as roof members.

Figure 47:
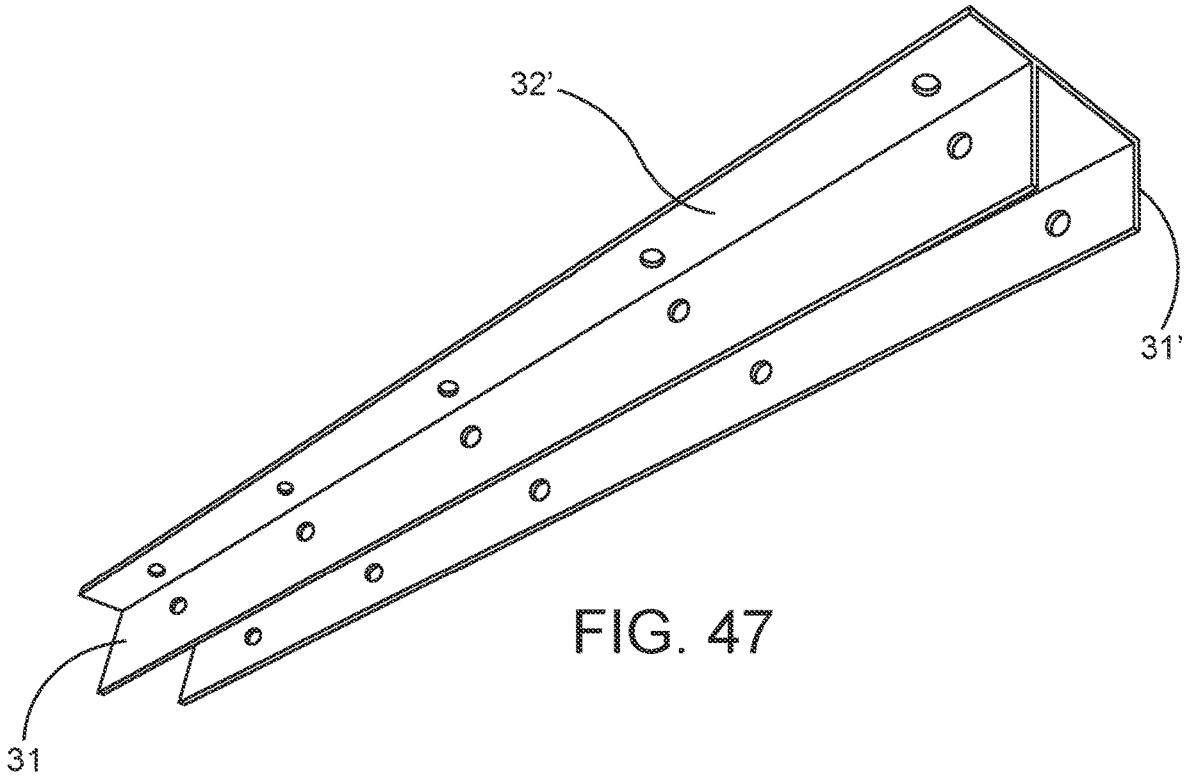
FIG. 47 is a perspective view of a track according to another embodiment of the present invention.
Figure 48:
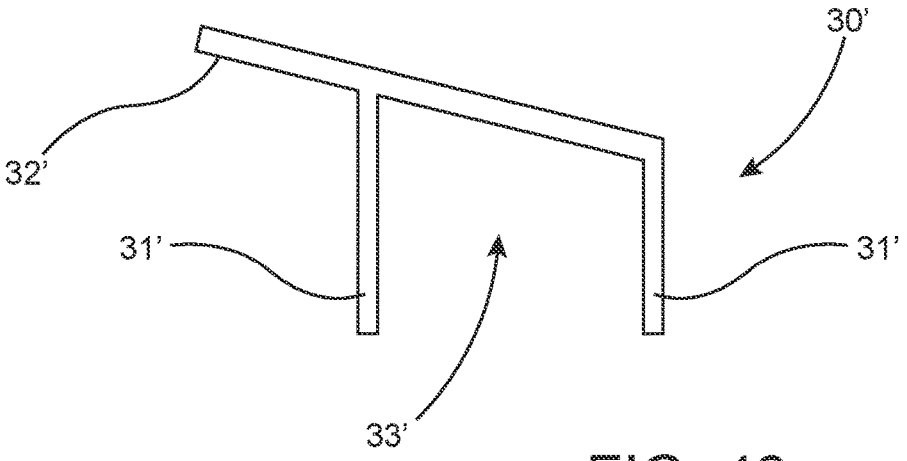
FIG. 48 is a section view of a track according to FIG. 47.

FIGS. 47 and 48 depict an alternative embodiment of a track 30' that may be utilized to facilitate construction of a gabled roof. As can be seen the webs 31' are angled relative to the external flange 32'. Therefore, when a panel member 10 or 10' is positioned at an angle to be used for a gabled roof, it may sit flush against the external flange 32', which facilitates better fastening.

Figure 49:
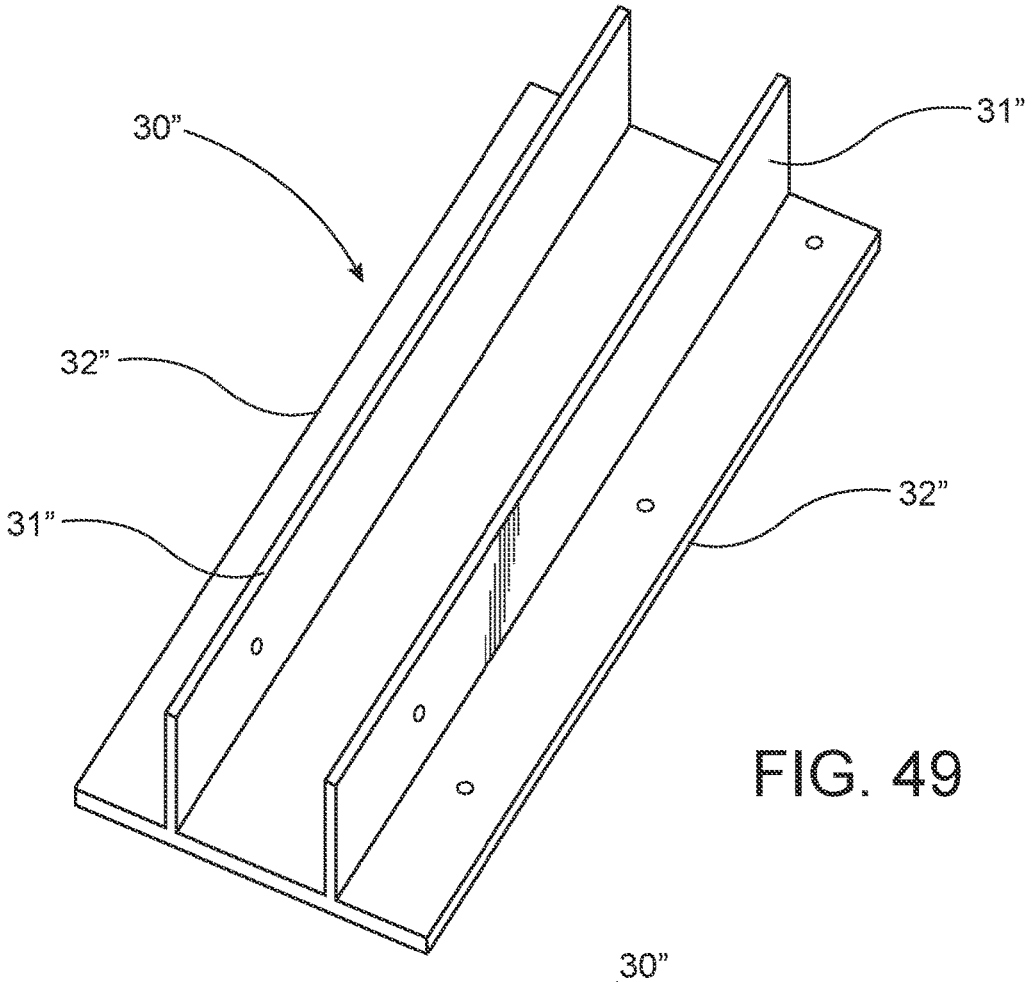
FIG. 49 is a perspective view of a track according to yet another embodiment of the present invention.
Figure 50:
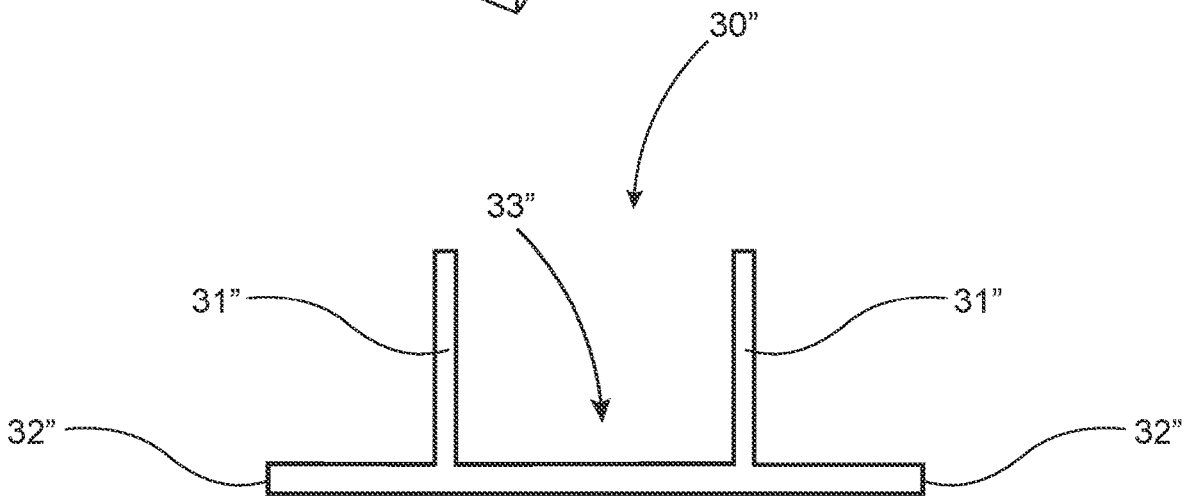
FIG. 50 is a section view of a track according to FIG. 49.

FIGS. 49 and 50 depict yet another embodiment of a track 30" which includes two external flanges 32", each projecting perpendicularly from the two webs 31". This embodiment of a track 30" is suitable for certain installation scenarios, such as when an interior wall is used to support a ceiling. The wall can be inserted into the channel between the two webs 31", while the ceiling panels can be secured to each of the two flanges 32".

Figure 51:
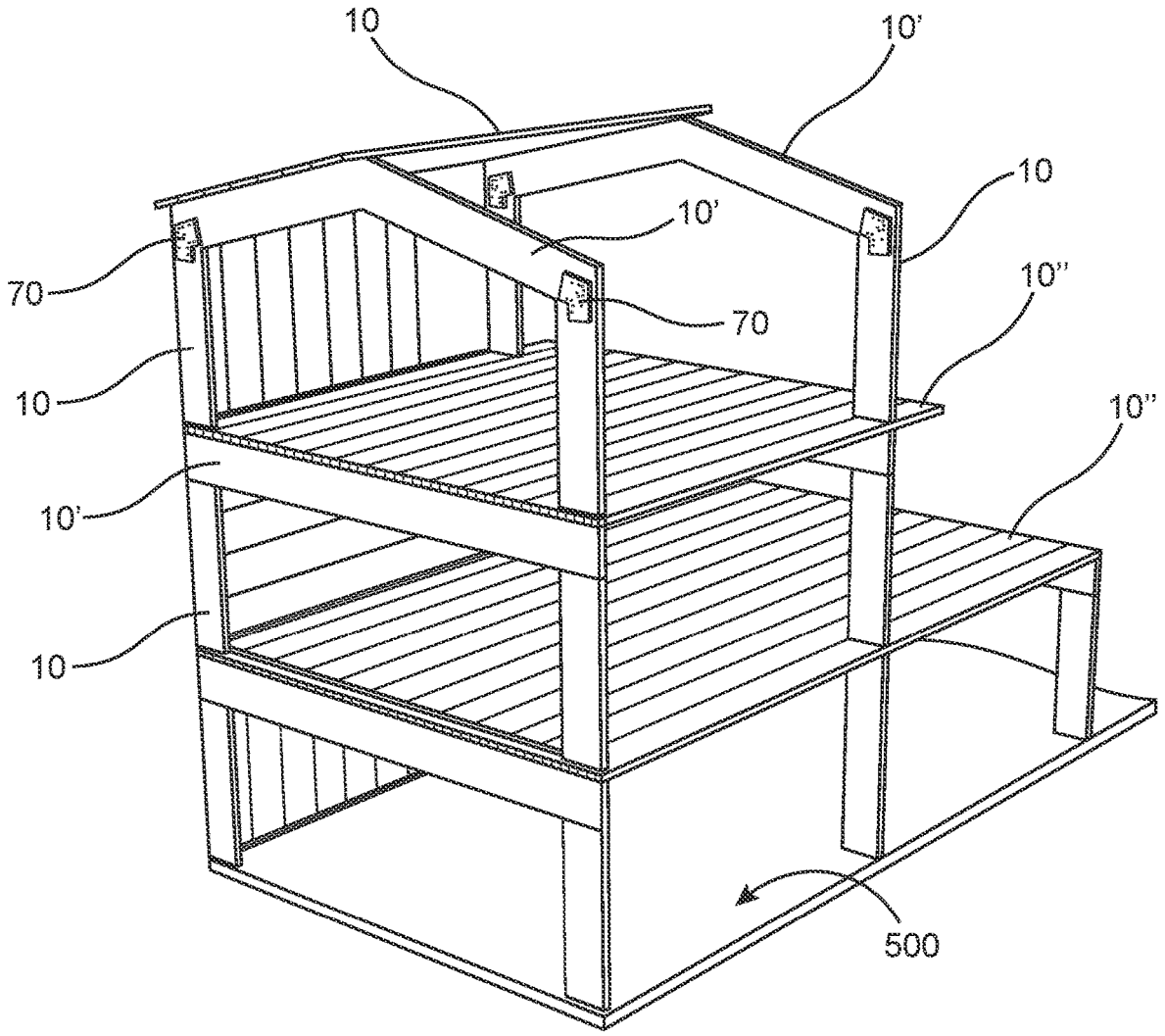
FIG. 51 is a partially constructed structure utilizing panel members according to one embodiment of the present invention.

FIG. 51 depicts a partially completed structure wherein the panels 10 are used in a vertically oriented configuration to support longer spans between panels acting as columns. For purposes of aiding disclosure in the context of FIG. 51, the vertically oriented panels are denoted as 10', while horizontally oriented panels are denoted as 10". The vertically oriented panels 10' can also be referred to as those supporting loads in the plane of the panel, while the horizontally oriented panels 10" can be referred to as those supporting loads out of the plane of the panel. It will be appreciated that the bending strength of the panel is much greater around its short edge than its long edge. Thus, the vertically oriented panels 10' are capable of withstanding much greater loads when cantilevered, suspended between two or more points, or otherwise not continuously supported, as compared to the horizontally oriented panels 10". The panels 10 acting as columns are configured to support axial loading.

Figure 52:
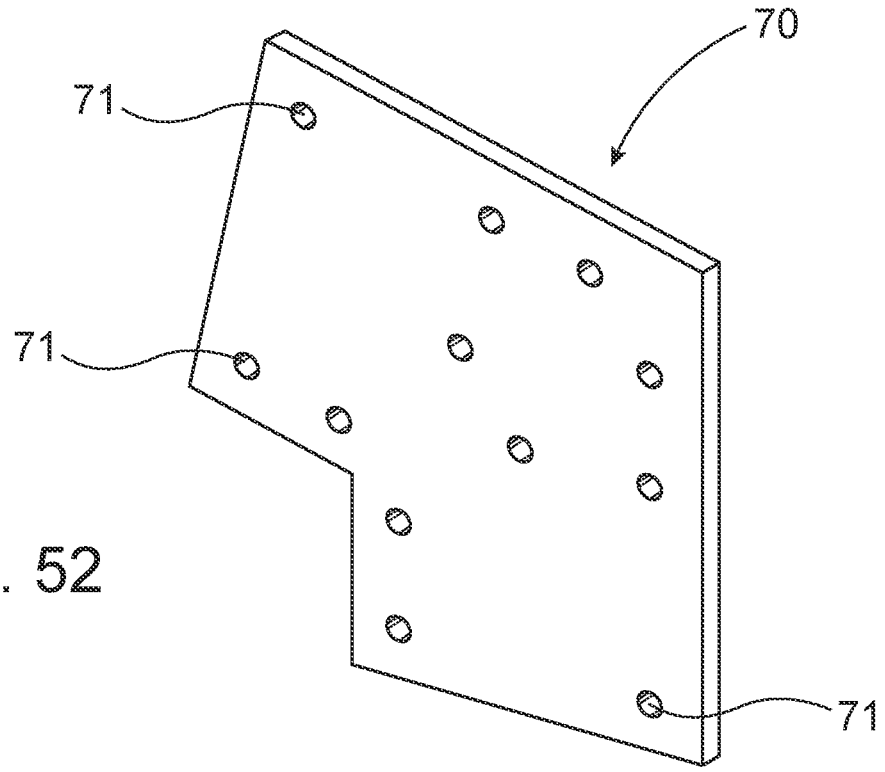
FIG. 52 is a perspective view of a gusset plate according to one embodiment of the present invention.
Figure 53:
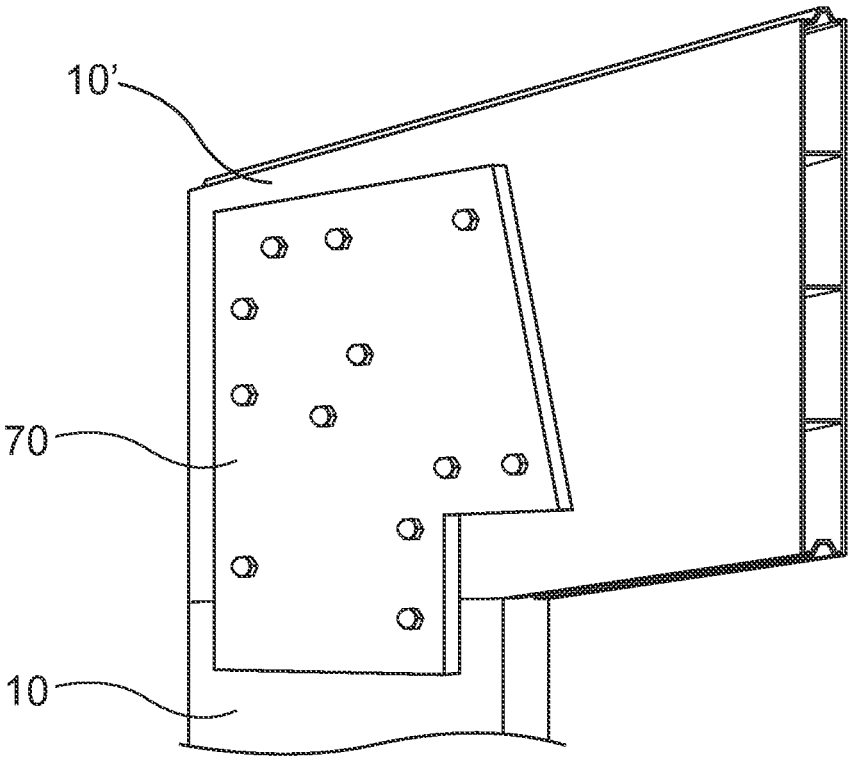
FIG. 53 is a perspective detail view showing the use of a gusset plate adjoining two panel members according to one embodiment of the present invention.

FIG. 51 also depicts a configuration to support a peaked roof using panel members 10' disposed in vertical orientation. With additionally reference to FIGS. 52 and 53, a gusset plate 70 can be used to facilitate the angled and vertically oriented connection between panel members 10 and 10'. The gusset plate 70 may include mounting apertures 71 to support the use of bolts or other fasteners.

Figure 54:
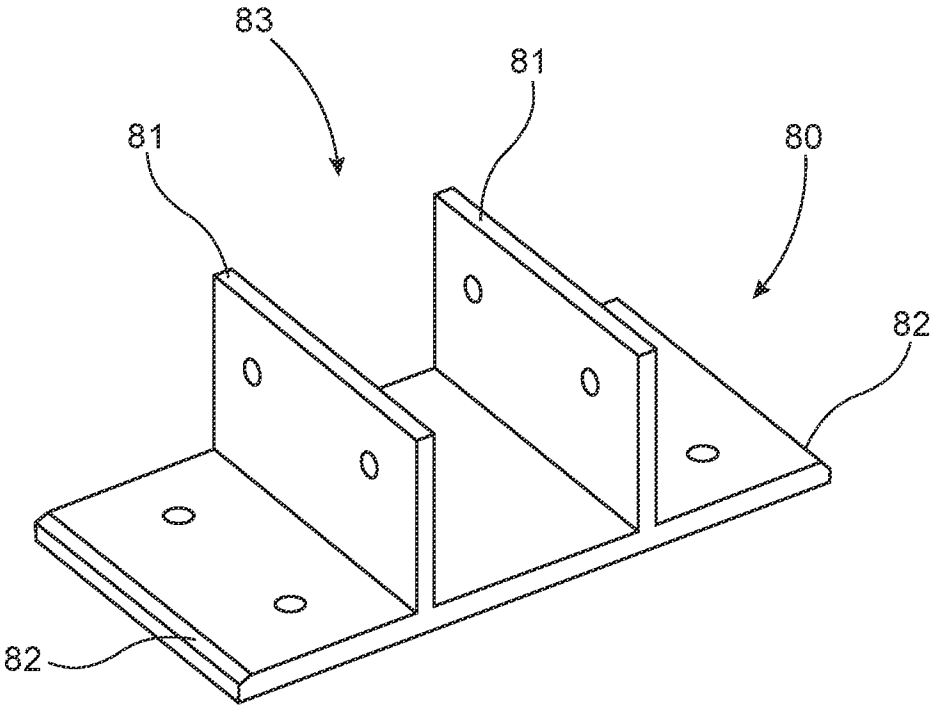
FIG. 54 is a perspective view of an insert plate according to one embodiment of the present invention.
Figure 55:
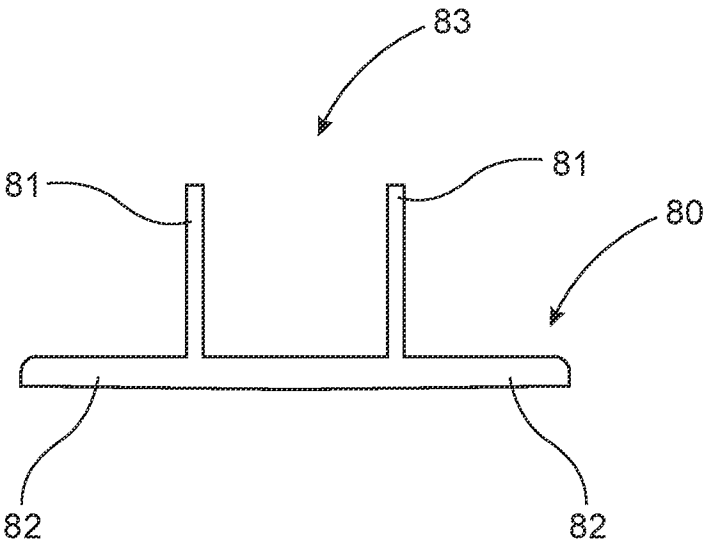
FIG. 55 is a section view of the insert plate according to FIG. 54.
Figure 56:
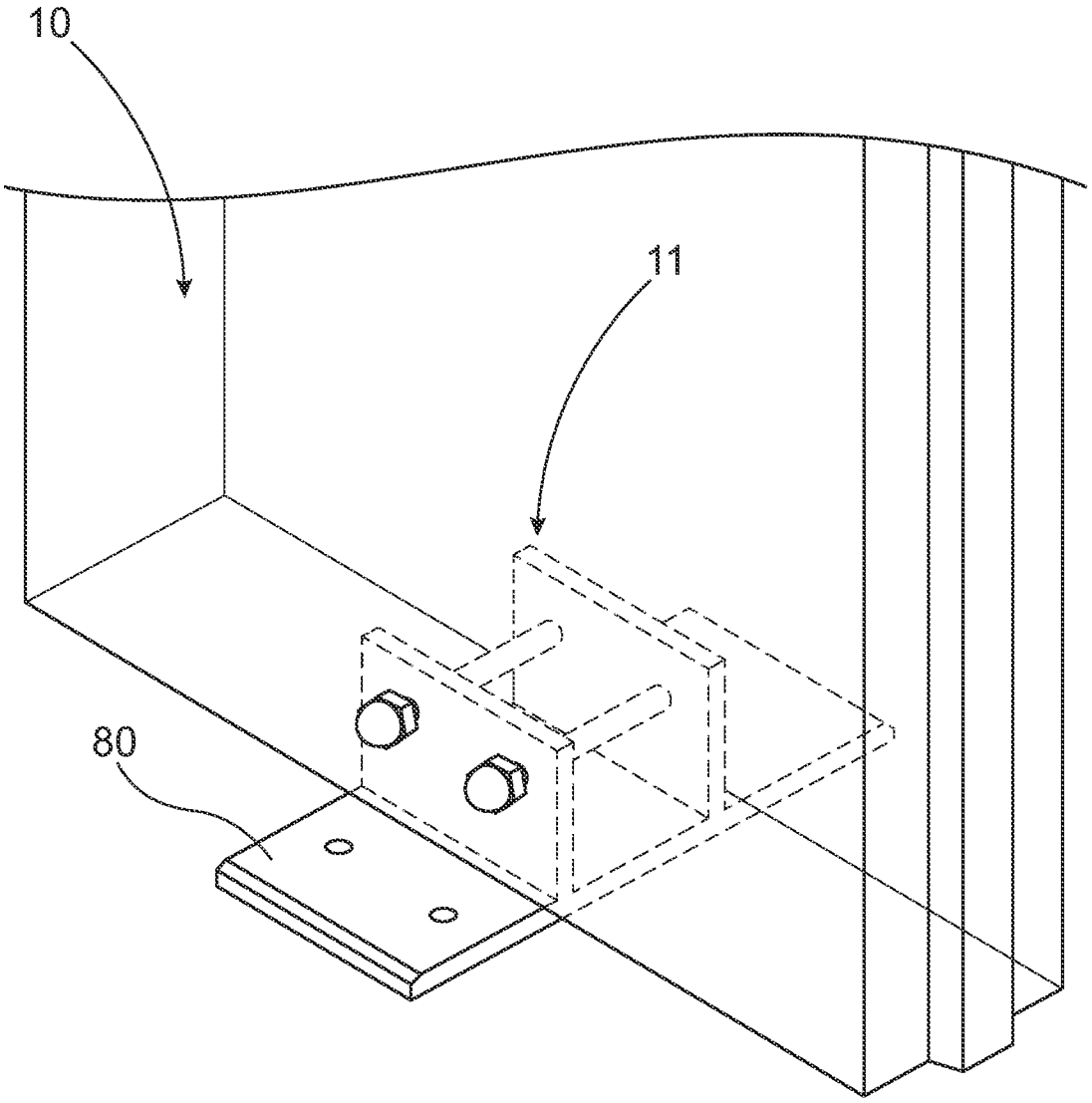
FIG. 56 is a perspective view showing an insert plate disposed within a channel of a panel member according to one embodiment of the present invention, where the panel member is depicted as partially transparent to aid disclosure.

FIGS. 54 and 55 depict an insert plate 80 in accordance with one embodiment of the invention. The insert plate includes two webs 81 at least partially defining an interior channel 83. Two flanges 82 project exteriorly of the insert plate 80. As depicted, the flanges 82 are orthogonal to the webs 81, but they may be disposed at any angle that is desired. Turning now to FIG. 56, it can be seen that the insert plate 80 is to be inserted within a channel 11 of a panel member 10. Therefore, the length of the insert plate 80 distance between the two webs 81 should be correspondingly configured and dimensioned with the channel 11. In a most preferred embodiment, this is approximately a 4 inch square (as disclosed above). Accordingly, as can now be seen, the insert plate 80 can be used in a similar fashion to the track 30, 30', and 30" in any scenario where it is more desirable to have the webs disposed within the panel 10. This can be for aesthetic purposes, for water proofing, or other reasons. Additionally, the insert plate 80 can also be useful for installations where a full length track member may not be suitable, such as when some of the channels 11 of a panel member 10 are used for mechanical, electrical, or plumbing conduits, or a variety of other purposes. Using a plurality of single channel-sized insert plates 80 may be preferable to cutting a track 30 to the desired size.

Figure 57:
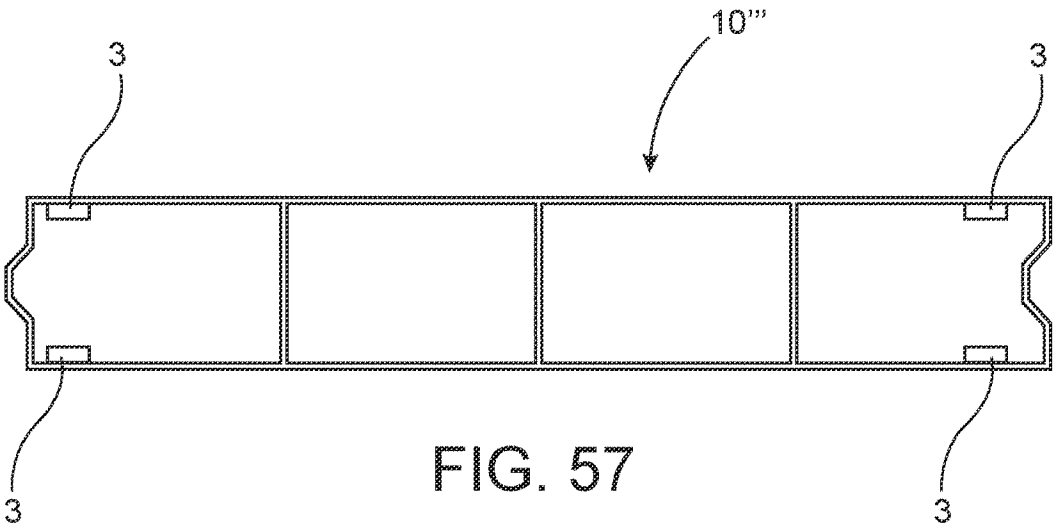
FIG. 57 is a front isometric view of a panel according to another embodiment of the present invention.
Figure 58:
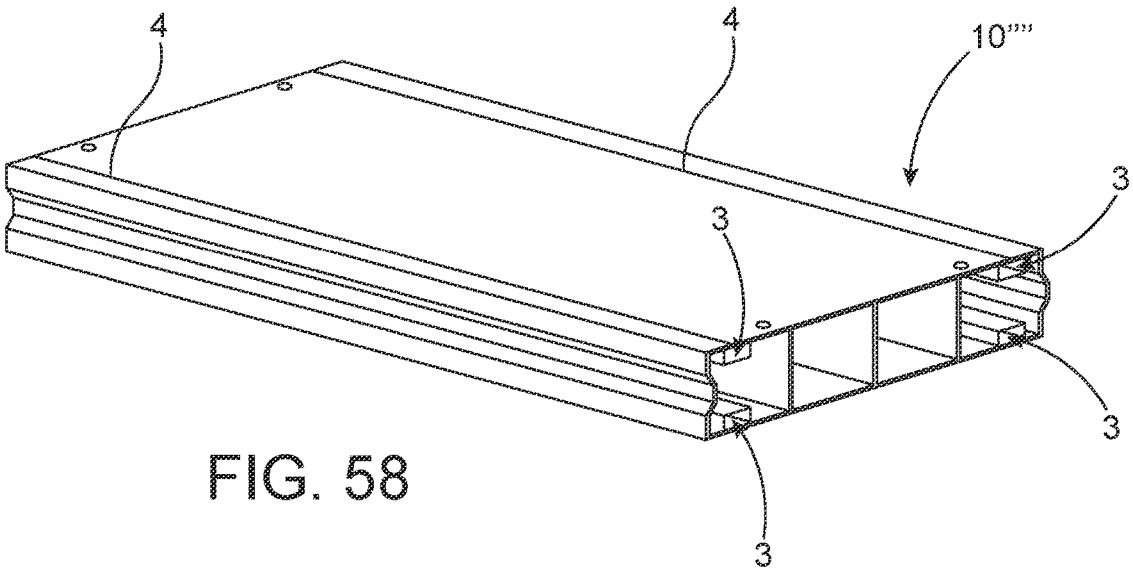
FIG. 58 is a front perspective view of a panel according to the embodiment of FIG. 57.

Turning to FIGS. 57 and 58, yet another embodiment of a panel 10"" is depicted which includes protrusions or bosses 3 along the inner faces of the panel. The bosses 3 provide additional material for a fastener to grip, which can reduce the total number of fasteners per panel necessary to securely retain the panels 10"". The bosses 3 can take on virtually and size, dimension, or placement that is desired for the purpose. In the depicted embodiment, the bosses 3 are arranged approximately ½ inch from the side of each panel 10"" and are approximately ¼ inch in thickness. The bosses 3 may run the entire length of the panel or may be truncated to the desired length. With specific reference to FIG. 58, a visual marker 4 can be provided on the outer surface to assist users with accurate placement of fasteners.

Figures 59, 60:
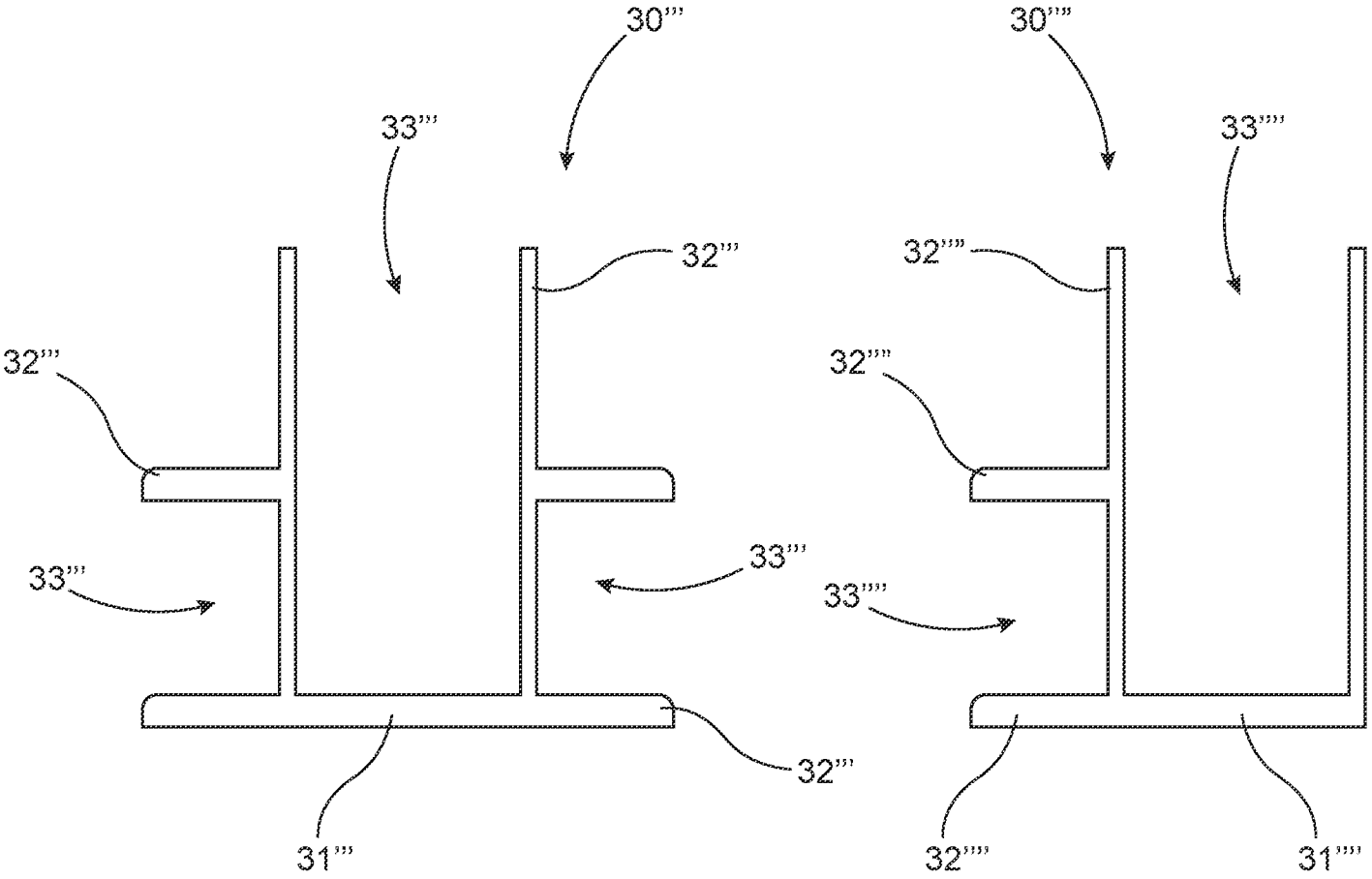
FIG. 59 is a front isometric view of a track according to another embodiment of the present invention.
FIG. 60 is a front isometric view of a track according to yet another embodiment of the present invention.

Turning to FIGS. 59 and 60, further embodiments of tracks 30''' and 30"" are depicted, respectively. Each track 30''', 30"" contains additional flanges 32''', 32"" relative to previously disclosed embodiments to provide a more structurally secure fitment of panels within the channels 33''', 33"" of the tracks 30''', 30"". This is due to the fact that fasteners can be driven into both flanges 32''', 32"" instead of relying on a single flange as previously disclosed. FIG. 59 shows a "T" shaped track 30''' which can accommodate three panels at each of the three channels 33'''. FIG. 60 shows an "L" shaped track 30"" which accommodates two panels. The tracks 30''', 30"" may be dimensioned and configured to suit any orientation or load capacity. For example, the flanges 32''', 32"" may be lengthened to provide additional support.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A structure comprising:

a plurality of identically formed, monolithically extruded panel members disposed to form a plurality of walls and ceilings within the structure;

each of said panel members including two oppositely disposed faces supported by a plurality of webs, the faces and webs being monolithically formed and defining a plurality of channels within said panel members;

a plurality of tracks fastened to a foundation of the structure and further configured to receive at least one end of each of said plurality of panel members;

said plurality of panel members forming an enclosure structured to prevent electromagnetic waves from entering or leaving the enclosure; and at least one of said panel members structured to receive the application of a low voltage electric current across at least one of said panel members.

2. The structure as recited in claim 1 wherein said channels accommodate insulation and conduits.

3. The structure as recited in claim 1, wherein fluctuations in said electrical current indicate temperature changes in the structure.

4. The structure as recited in claim 1 wherein said panel members are constructed of extruded aluminum.

5. The structure as recited in claim 1 wherein said panel members are comprised of 6082 T6 aluminum alloy.

6. The structure: as recited in claim 1 further comprising a plurality of mounting apertures in each of said two oppositely disposed faces.

7. The structure as recited in claim 1 wherein a thickness of said faces and webs is between approximately 0.065 and 0.25 inches.

8. The structure as recited in claim 1 wherein a distance between said two opposite faces is approximately 4.00 inches.

9. The system as recited in claim 1 wherein each of said panel members further comprise ridge and valley members configured to mate said panel members when one panel member is placed in adjoining relation to another panel member.

10. A structure comprising:

a plurality of identically formed, monolithically extruded panel members disposed to form a plurality of walls and ceilings within the structure;

each of said panel members including two oppositely disposed faces supported by a plurality of webs, the faces and webs being monolithically formed and defining a plurality of channels within said panel members;

a plurality of tracks fastened to a foundation of the structure and further configured to receive at least one end of each of said plurality of panel members;

said plurality of panel members forming an enclosure structured to prevent electromagnetic waves from entering or leaving the enclosure; and at least one of said panel members structured to receive the application of a low voltage electric current across at least one of said panel members wherein fluctuations in said electrical current indicate temperature changes in the structure.

11. The structure as recited in claim 10 wherein said channels accommodate insulation and conduits.

12. The structure as recited in claim 10 wherein said panel members are constructed of extruded aluminum.

13. The structure as recited in claim 10 wherein said panel members are comprised of 6082 T6 aluminum alloy.

14. The structure as recited in claim 10 further comprising a plurality of mounting apertures in each of said two oppositely disposed faces.

15. The structure as recited in claim 10 wherein a thickness of said faces and webs is between approximately 0.065 and 0.25 inches.

16. The structure as recited in claim 10 wherein a distance between said two opposite faces is approximately 4.00 inches.

17. The system as recited in claim 10 wherein each of said panel members further comprise ridge and valley members configured to mate said panel members when one panel member is placed in adjoining relation to another panel member.

* * * * *